US006626248B1

(12) United States Patent
Roberts et al.

(10) Patent No.: US 6,626,248 B1
(45) Date of Patent: Sep. 30, 2003

(54) ASSEMBLY AND METHOD FOR JARRING A DRILLING DRIVE PIPE INTO UNDERSEA FORMATION

(75) Inventors: Billy J. Roberts, deceased, late of Houston, TX (US), by Jenova J. Roberts, legal representative; Arley G. Lee, Katy, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/533,404

(22) Filed: Mar. 23, 2000

Related U.S. Application Data

(60) Provisional application No. 60/133,828, filed on May 12, 1999, and provisional application No. 60/125,768, filed on Mar. 23, 1999.

(51) Int. Cl.[7] ..... E21B 7/12

(52) U.S. Cl. ..... 175/5; 166/358; 175/135; 175/293; 405/249

(58) Field of Search ..... 175/135, 296, 175/293, 5; 166/358; 173/91; 405/249

(56) References Cited

U.S. PATENT DOCUMENTS

| | | | | | |
|---|---|---|---|---|---|
| 3,490,550 | A | * | 1/1970 | Horton | 405/259 |
| 3,526,283 | A | * | 9/1970 | Horstketter et al. | 405/259 |
| 3,732,143 | A | * | 5/1973 | Joosse | 175/6 |
| 3,754,607 | A | * | 8/1973 | Van Daalen | 175/7 |
| 3,782,460 | A | * | 1/1974 | Skinner | 175/5 |
| 3,817,335 | A | * | 6/1974 | Chelminski | 173/127 |
| 3,831,386 | A | * | 8/1974 | Phares et al. | 405/259 |
| 3,932,999 | A | | 1/1976 | Todd | 61/53.5 |
| 4,040,264 | A | | 8/1977 | Neilon | 61/86 |
| 4,048,686 | A | | 9/1977 | Ege | 9/8 |
| 4,117,693 | A | | 10/1978 | Fournie | 405/171 |
| 4,121,529 | A | | 10/1978 | Smith et al. | 114/331 |
| 4,191,494 | A | | 3/1980 | Nakamura et al. | 405/171 |
| 4,545,444 | A | | 10/1985 | Webb et al. | 175/296 |
| 4,681,173 | A | * | 7/1987 | Disher et al. | 175/7 |
| 5,082,069 | A | | 1/1992 | Seiler et al. | 175/5 |
| 5,174,393 | A | | 12/1992 | Roberts et al. | 175/297 |
| 5,184,686 | A | | 2/1993 | Gonzalez | 175/5 |
| 5,449,253 | A | | 9/1995 | Roger | 405/245.1 |
| 5,456,326 | A | * | 10/1995 | Raines | 175/57 |
| 5,503,228 | A | | 4/1996 | Anderson | 166/301 |
| 5,660,234 | A | | 8/1997 | Hebert et al. | 166/368 |
| 6,102,119 | A | | 8/2000 | Raines | 166/244.1 |

FOREIGN PATENT DOCUMENTS

| | | | |
|---|---|---|---|
| EP | 0 525 865 A1 | 2/1993 | E02D/7/08 |

OTHER PUBLICATIONS

GB007129.0, Aug. 22, 2000, UK Search Report.

* cited by examiner

*Primary Examiner*—Heather Shackelford
*Assistant Examiner*—John Kreck

(57) ABSTRACT

A method for driving a drive pipe into a subsea formation, the method being comprised of the following steps: suspending the drive pipe from a drill string; moving at least one mass in a direction having an upward component and within the drive pipe; accelerating at least one mass relative to the drive pipe, wherein the at least one mass is accelerated within the drive pipe; transferring energy from the accelerated at least one mass to the drive pipe; isolating the drill string from energy from the accelerated at least one mass; and removing a core of formation from within the drive pipe after the transferring. A system for driving a drive pipe into a subsea formation, the system having: a drill string suspendable from a marine vessel; a running tool attachable to the drill string, wherein a top of the drive pipe is connected to the running tool; at least one mass adapted to fit within the drive pipe; an accelerator of the at least one mass, wherein the accelerator is in mechanical communication with the running tool and the at least one mass; and a transferror of energy from the at least one mass to the drive pipe, wherein the transferror transfers energy after the at least one mass is accelerated by the accelerator.

26 Claims, 20 Drawing Sheets

ASSEMBLY AND METHOD FOR JARRING A DRILLING DRIVE PIPE INTO UNDERSEA FORMATION

CONTINUATION STATEMENT

This application claims the benefit of U.S. Provisional Application No. 60/133,828, filed May 12, 1999, and U.S. Provisional Application No. 60/125,768, filed Mar. 23,1999.

TECHNICAL FIELD OF THE INVENTION

The present invention relates generally to deep water offshore drilling operations which utilize floating rigs, and more particularly, to a method for installing a drilling assembly, including a drive pipe, into a sea-bottom formation.

BACKGROUND OF THE INVENTION

In deep water drilling operations, shallow water flow (SWFT) hazards have become increasingly troublesome. SWF derives its name from the phenomena of a flow, emanating from a subsurface and overpressurized zone, back to the seafloor. An overpressurized subsurface zone is formned naturally when an impermeable seal is formed over sandy settlements by rapid deposition of silty material. As the silty material is deposited over the sealed, sandy aquifer, the trapped water in the sandy settlement is unable to escape. Over time, the pressure increases in the sandy aquifer until the pressure developed is equal to or greater than the hydrostatic pressure at the depth of water at the location of the sandy aquifer. A shallow water flow occurs when the impermeable seal of silty material is penetrated to release the overpressure within the sandy aquifer. In some cases, the pressures are high enough to cause powerful flows of water and sand into the well bore. Waterflows destabilize the wellbore through erosion to collapse and in some cases damage the well bore and others adjacent thereto. Shallow waterflow hazards have been encountered in many areas of the world and continue to be a problem in deepwater drilling operations.

One solution for avoiding shallow waterflow hazards is to use a drive pipe. The drive pipe is driven into the formation past the high pressure sandy aquifer. The purpose of the drive pipe is to prevent the formation from collapsing into the borehole during this initial drilling. Since the drive pipe is driven into the formation, the soil is compressed and compacted in the immediate vicinity of the drive pipe. Compacted soil seals the drive pipe in the formation to prevent shallow water flow around the drive pipe. The drive pipe becomes the casing for the well bore through which subsequent drilling operations may be conducted.

In a typical offshore drilling installation, a length of drive pipe is hung from the floating rig by a string of drill collars and drill pipe lowered to the sea bottom. In such a deepwater installation, the water depth may be up to 10,000 feet or greater. In the drilling assembly, the string of drill collars are connected to the top of the drive pipe by way of a running tool having a J-latch, or other releasing mechanism. The drilling assembly may also be connected to the drive pipe by way of a conventional J-latch assembly engaged with lugs or other means attached to the inside or outside of the drive pipe. The drill string continues below the running tool and extends down the entire length of the interior of the drive pipe. The lower end of the drill string assembly terminates with a jet sub or downhole motor connected to a stabilized drill bit.

In a conventional assembly, the drill bit is located at the mouth or lower opening of the drive pipe, and is driven by the motor to function as a jetting assembly to drill a hole approximately the size of the inner diameter of the drive pipe. The drill string is initially connected to the drive pipe through a first position of the running tool to enable both elements to move downwardly together. Therefore, as the drill bit penetrates the sea bottom formation, the drill string lowers, and the drive pipe falls snugly into the bore hole made from the rotating and jetting action of the bit. This drilling continues until substantially the entire section of drive pipe penetrates the formation or until such time as the gravitational forces acting on the drive pipe will no longer overcome the effect of skin friction. Once this is accomplished, the drill string is disconnected from the drive pipe at the running tool connection to enable the drill string to move independently with respect to the drive pipe, and continue its drilling operation. In this mode, the drill bit continues to drill beyond the drive pipe, into the formation, while the drive pipe remains stationary.

During the initial drilling, when the drive pipe is penetrating into the formation due to gravitational force, regular seawater is utilized as the drilling fluid. Thus the sea water, traveling down through the interior of the drill string, functions to clean the bore hole bottom, and carry the cuttings up the annulus formed by the exterior of the drill string and the interior of the drive pipe. This fluid then exits the annulus at the top of the drive pipe to be released into the sea.

For subsequent drilling, the drill string is pulled out of the hole and the drill collars are stood back on the derrick of the floating platform. A conductor pipe is lowered from the rig to extend and attach to the top of the drive pipe to communicate with the annulus inside the drive pipe. Regular drilling mud is then utilized in the drilling operation by having it pumped down the drill string and up through the annuluses of the drive pipe and the conductor pipe. This conductor pipe also serves as a means to bring cuttings from the drill bit to the surface.

Drive pipes are usually 30 to 36 inches in diameter, having a wall one inch thick, although in some instances, the drive pipe can be 42 inches, or larger, in diameter, with a two inch wall thickness. Drive pipes are typically 350 to 450 feet in length for shallow water drilling operations if driven from the surface. In conventional drilling operations, it has been found that a drive pipe can not penetrate beyond a certain amount, usually around the 450 feet length, because at that length, the resistance caused by skin friction becomes greater than the force of gravity and the force applied from the surface by conventional hammer means. The drive pipe will reach a point of refusal and any further force applied to the uppermost section of the drive pipe will cause yielding of the pipe material and any further driving efforts must be discontinued.

In deep water drilling operations, drive pipes having lengths of 1000 feet or more are sometimes required to mitigate shallow water flow hazards. Therefore, auxiliary means for driving drive pipes are necessary to augment the gravitational forces acting on the drive pipes to increase the depth of penetration of the drive pipes.

One option has been to use a hammer applied to the top of the drill string to help drive the drive pipe at the end of the drill string downward. However, because of the great drill string lengths involved, the energy transferred to the drive pipe through the drill string is not sufficient.

A further option has been to apply conventional hammers directly to the top of the drive pipe at the connection between the drive pipe and the drill sting. Hydraulic pile and pipe drivers of various configurations are known. An example of a hydraulic pipe driver attached to the top of the pipe is disclosed in U.S. Pat. No. 4,964,473, incorporated herein by reference. The device has a submerged power converter wherein hydraulic pressure energy is generated in the power converter to drive the driver and wherein the power converter is driven by pressurized surrounding water after the energy transfer is exhausted into the surrounding water. Further examples of pipe drivers used to drive pipes and piles into a sea bed for securing platforms and other structures are disclosed in U.S. Pat. No. 4,601,349; 5,662,175; 5,090,485; 4,817,734; 4,818,149; 4,856,938; 5,088,567; 4,872,514; and 5,228,806, all incorporated herein by reference.

In any drive system using a conventional hydraulic hammer applied to the top of the drive pipe, there are significant drawbacks: (1) an umbilical conduit must be run from the floating vessel to the hammer; (2) conventional hydraulic hammers apply relatively low impacts; and (3) the drive pipe is not driven vertically. First, typical drive pipe hammers have umbilical cables which supply electrical or hydraulic forces to the hammers. At water depths where drive pipes are required (5,000–7,000 feet), the umbilical cord required is an impractical length. Second, conventional hydraulic hammers do not deliver large enough impacts to drive the drive pipe. Since the impact is delivered to the top of the drive pipe, the relative small impact energy is absorbed by the lengthy drive pipe. Impacts applied directly to the drive pipe may damage the pipe. Third, the drive pipe is not always driven straight down, as desired. Instead, the drive pipe more than likely deviates from vertical as it is driven. An installed drive pipe, which is not vertical, is generally unacceptable for subsequent drilling operations.

Conventional hammers are made even less effective by the need to use a "cone" shaped driving shoe to penetrate the formation. Since the conventional hammers must be attached to the top of the drive pipe, there is no ability to run a mud motor/drill device into the drive pipe from the drill string. Therefore, a driving shoe must be placed at the leading end of the drive pipe to compress and deviated the soil from locations immediately beneath the drive pipe to locations around the drive pipe. This increases the skin friction on the outside of the drive pipe which further impedes the drive pipe's progress into the formation. Similarly, if a conventional hydraulic hammer on an umbilical conduit is positioned within the drive pipe to impact the drive pipe at a point towards its bottom, a driving shoe must be employed. If the hydraulic hammer is within the drive pipe, it is impossible to dispose of the formation "core" as the pipe is being driven. Thus, it is impossible to place a conventional hammer within the drive pipe.

Therefore, there is a need for a drive pipe driving system which does not require an umbilical conduit, applies a sufficient impact to drive the drive pipe, and drives the drive pipe vertically. The drive system must also be versatile to allow for a drive pipe having a driving shoe or a drill located in the mouth of the drive pipe.

SUMMARY OF THE INVENTION

The present invention obviates the above-mentioned problems by providing impact forces from within the drive pipe at a location toward the bottom or leading end of the drive pipe. In this manner, the energy transfer is much more efficient, and the pipe will be driven vertically.

The drilling assembly includes an impact tool hung, under tension, to the drill string directly below the running tool connection. An isolator is installed into the drill string directly above the running tool connection to prevent shock loads from being transferred to the drill string above.

The impact tool comprises inner and outer tubular body members, relatively movable with respect to each other, in an axial direction. The inner body member is connected to the upper drill string extending to the rig. The outer body member is connected to the lower drill string section that extends within the drive pipe to the drill bit. In this embodiment, the inner body member remains stationary, while the outer body member is movable in the up and down direction.

The impact tool further comprises a jar section for providing a downward jarring force on the inner body member which, in turn, transfers the jarring force to the top of the drive pipe through the running tool assembly. The tool also comprises one or more pull sections for providing a closing force between the two members to lift the outer member, the lower drill string, and the drill bit off the bore hole bottom. The jarring force is caused by releasing the last mentioned three components and allowing them to drop a predetermined distance, at which time impact occurs within the body of the jar. The impact tool further comprises a compression chamber or a mechanical device such as a spring, to function as an energy intensifier to augment the jarring force acting on the drive pipe.

The isolator includes two members axially movable with respect to each other, and interconnected to adjacent upper and lower drill collar sections. The isolator includes a compression chamber formed between the two members. The isolator functions to enable the drill string located above the running tool to elongate in order to compensate for the sudden travel of the drive pipe as it is being jarred downwardly. This enables the drill collars above the running tool assembly to remain in tension during operation to prevent unwanted vertical deviation of the drive pipe during installation.

Finally, a compensating tool is located on the drill string adjacent the motor and the bit. This tool also includes two members axially movable with respect to each other for connection to adjacent upper and lower drill collar sections. The compensating tool also includes a compression chamber formed between the two members. The tool functions to enable the drill string located adjacent the drill bit to become shorter to compensate for the sudden travel of the drive pipe downwardly and prevent the bit from impacting heavily on the formation. The compensating tool allows some slack in the string to allow the bit to rise and therefore prevent the bit from plugging while the drive pipe is being jarred into the formation. The drill bit and downhole motor drill out the formation "core", if so desired.

Other advantages of the inventive system are the ability to infinitely vary the impact loads, alter the location of the impact within the length of the drive pipe and the equal distribution of a large uniform mass, all of which contribute to the desirability and performance of the tool. Overall, the assemblies and methods of the present invention perform better than conventional hydraulic hammers.

A system for floating rig installations is provided for efficiently driving an extraordinarily long length of drive pipe into the sea bottom formation, while still preserving the integrity of the rig and the bottom hole assembly.

With the system of the present invention, the drive pipe is driven into the subsea formation with the drill string above the drive pipe in constant tension. A reciprocation occurs within the drive pipe so that the drive pipe may be driven from a floating vessel. The entire weight of the drive pipe and impacting system is suspended on a compressed gas within a cylinder of an isolation sub. The isolation sub prevents shock loads from being transferred up the drill string to the floating vessel.

In one embodiment of the invention, pump pressure lifts the bottom hole assembly and closure jar. Thus, pump pressure is ultimately transformed into an impact force on the drive pipe when the lifted mass is allowed to free fall onto the drive pipe. Lift pistons within the impact tool are designed to move out of the way when a pressure differential across them changes. This insures that the lift pistons do not impede the falling velocity of the mass prior to impact. Depending on the particular system, welded or preformed lugs are positioned inside the drive pipe to transfer impact loads from the impact tool to the drive pipe. Some systems of the present invention have an isolator, an impact device and a cushion sub used in combination.

While some embodiments of the invention simply allow the mass (drill collars) to freefall, in other embodiments a device is used to enhance or amplify the downward acceleration of the mass. For example, released potential energy stored in a spring, compressed gas chamber, combustion chamber, etc. is used to accelerate the falling mass in addition to gravity.

Many systems of the invention use a vertically reciprocating weight suspended within the drive pipe, but attached to the top and bottom of the drive pipe. Thus, the impact tool is used in conjunction with the relatively stationary running tool. The running tool may be latched or unlatched from the drill string. Thus, if the drilling motor stalls, the running tool may be unlatched from the drill string so that the drilling motor may be lifted up relative to the formation core to free the drill bit. In alternative embodiments, gas or pump pressure is used to cushion the drill bit from impact forces on the drive pipe. If the drill-out system is used, the ability of the motor and drill bit to float on top of the formation and not impact the bottom is a key feature.

In alternative embodiments, the inner members of the impact device are held stationary relative to the drive pipe during impact. Of course, since the drive pipe is driven into a subsea formation, the impact tool is used underwater in most systems of the present invention.

One aspect of the present invention is to use a detent to suspend the mass (drill collars) momentarily to provide the lift cylinders enough time to decompress. In one embodiment, the detent is a cylinder with a detent ring. Belleville springs cushion the detent cylinder when the drill collars are at the end of the raising stroke. Depending on the time delay necessary for suspending the mass, the detent ring will be either a short cocking detent or a long cocking detent. An example of a "short cocked" detent is disclosed in U.S. Pat. No. 5,174,393, incorporated herein by reference.

While the present invention is described for use in driving a drive pipe into a subsea formation, the system could also be used to set subsea anchors or any other device which must be driven into a subsea formation.

Within the impact device, there are hydraulic tattle-tales to determine open and closed positions of the tool. While any type of tattle-tale known to persons of skill may be used, one particular type comprises a rubber sleeve containing grease or oil. A pressure sensor detects the pressure of the grease or oil within the rubber sleeve. This information is returned to the operator at the surface.

According to one aspect of the invention, there is provided a method for driving a drive pipe into a subsea formation, the method having the steps of: accelerating at least one mass relative to the drive pipe, wherein the at least one mass is accelerated within the drive pipe; and transferring energy from the accelerated at least one mass to the drive pipe.

According to a further aspect of the invention, there is provided a method for driving a drive pipe into a subsea formation, the method being comprised of the following steps: suspending the drive pipe from a drill string; moving at least one mass in a direction having an upward component and within the drive pipe; accelerating at least one mass relative to the drive pipe, wherein the at least one mass is accelerated within the drive pipe; transferring energy from the accelerated at least one mass to the drive pipe; isolating the drill string from energy from the accelerated at least one mass; and removing a core of formation from within the drive pipe after the transferring.

According to still another aspect of the invention, there is provided a method for driving a drive pipe into a subsea formation, the method having the following steps: suspending the drive pipe from a drill string; removably attaching the drill string to the top of the drive pipe; moving at least one mass in a direction having an upward component and within the drive pipe; accelerating at least one mass relative to the drive pipe, wherein the at least one mass is accelerated within the drive pipe; transferring energy from the accelerated at least one mass to the drive pipe near a bottom of the drive pipe; and isolating the drill string from energy from the accelerated at least one mass.

Relative to another aspect of the invention, there is an impact tool for driving a drive pipe into a subsea formation, the impact tool having: at least one mass adapted to fit within the drive pipe; an accelerator of the at least one mass; and a transferror of energy from the at least one mass to the drive pipe, wherein the transferror transfers energy after the at least one mass is accelerated by the accelerator.

In a further aspect of the invention, there is provided a system for driving a drive pipe into a subsea formation, the system having: a drill string suspendable from a marine vessel; a running tool attachable to the drill string, wherein a top of the drive pipe is connected to the running tool; at least one mass adapted to fit within the drive pipe; an accelerator of the at least one mass, wherein the accelerator is in mechanical communication with the running tool and the at least one mass; and a transferror of energy from the at least one mass to the drive pipe, wherein the transferror transfers energy after the at least one mass is accelerated by the accelerator.

In an alternative aspect of the invention, there is a system for driving a drive pipe into a subsea formation, the system having: a drill string suspendable from a marine vessel; a running tool attachable to the drill string, wherein a top of the drive pipe is connected to the running tool; an isolator sub between and in mechanical communication with the drill string and the running tool; at least one mass adapted to fit within the drive pipe; an accelerator of the at least one mass having: a first body member mechanically communicable with the at least one mass, a second body member mechanically communicable with the running tool, an actuator of the first and second body members relative to each other, wherein the actuator works against gravity, and a detent of the first and second body members relative to each other; the system further having an impulse section that accelerates the at least one mass; and a transferror of energy from the at least one mass to the drive pipe, wherein the transferror transfers energy after the at least one mass is accelerated by the accelerator.

BRIEF DESCRIPTION OF THE DRAWINGS

The present invention is better understood by reading the following description of nonlimitative embodiments with reference to the attached drawings wherein like parts in each of the several figures are identified by the same reference characters, and which are briefly described as follows.

It is to be noted, however, that the appended drawings illustrate only typical embodiments of this invention and are therefore not to be considered limiting of its scope, as the invention may admit to other equally effective embodiments.

DESCRIPTION OF THE PREFERRED EMBODIMENT

Figure 1:
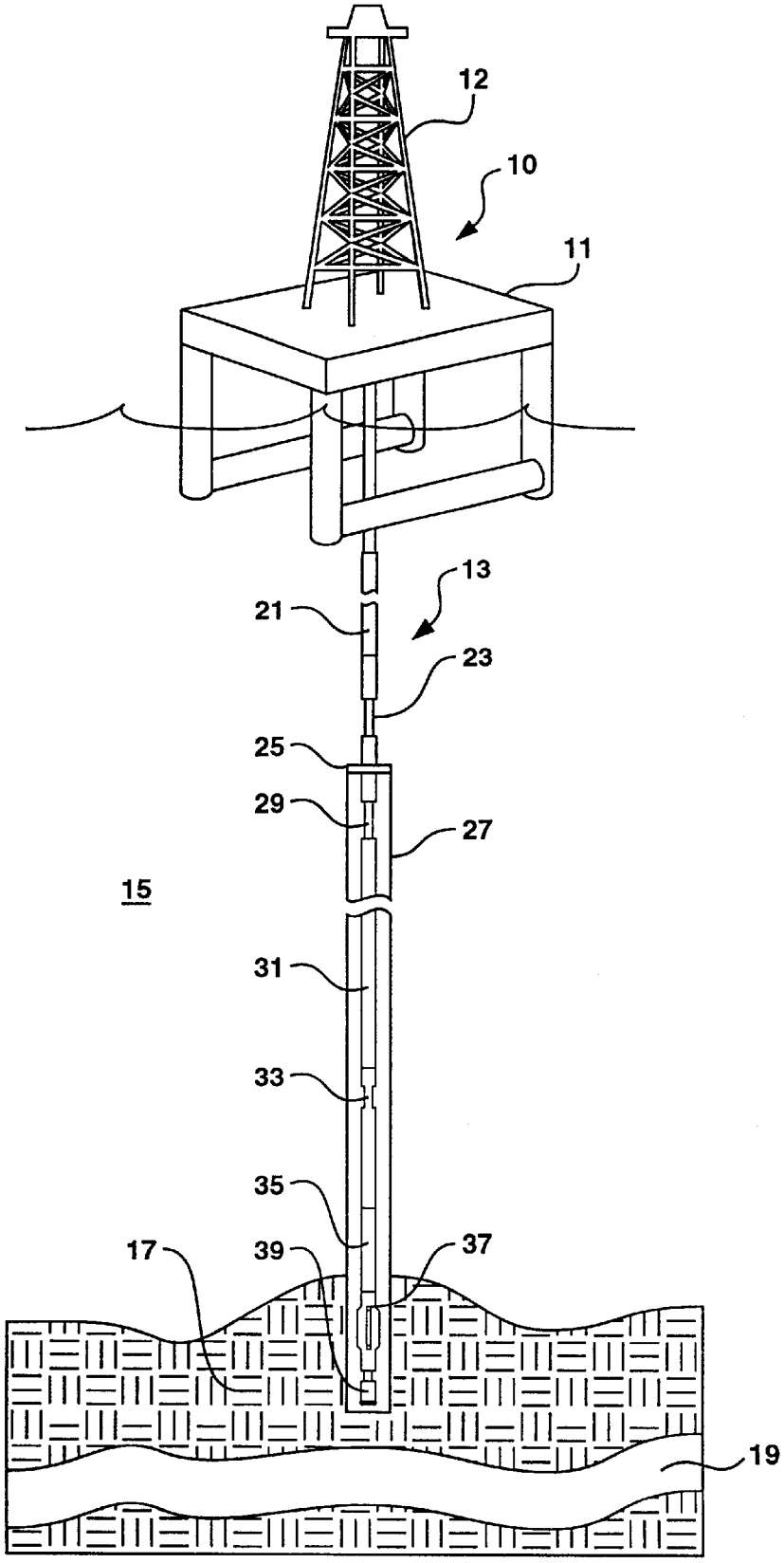
FIG. 1 is a schematic view of a floating rig incorporating the system for driving a drive pipe into the sea bottom formation according to the present invention.

FIG. 1 shows an offshore, floating drilling unit, generally indicated by arrow 10. The drilling unit 10 comprises a drill ship or semi-submersible floating platform 11 having conventional tool handling equipment 12 mounted on it. The platform 11 also has conventional means for supporting a drill string, generally indicated by arrow 13. The platform 11 is adapted to operate on the open sea 15, which has a bottom formation 17, generally in the range of, but not limited to, 5,000 to 7,000 feet below sea level. In some instances, there may also be underground streams 19 flowing beneath the sea bottom 17.

The drill string 13 comprises a plurality of drill pipe and drill collars 21 extending from the drilling unit 10 and attached to the top of the predetermined length of drive pipe 27, when the bottom of the drive pipe is approximately at the depth of the ocean floor. Both drill pipe and drill collar sections are approximately 30 feet in length and are supported in tension from the drilling unit 10 above.

An isolator 23 is mounted on the drill string 13, directly below the upper section of drill collars 21. The isolator 23 functions to isolate and prevent the jarring impact forces and accelerated movements occurring below from travelling up the string of drill pipe and drill collars 21 to the floating platform 11.

Located directly below the isolator 23 is a running tool 25, which is adapted to support a drive pipe 27. The drive pipe 27 is usually around 750 feet in length, although other lengths may be utilized. The drive pipe 27 also is usually 30 to 48 inches in diameter, having a wall thickness of one to two inches, although other dimensions can be utilized. In operation, it is desired to lower the drive pipe 27 onto the sea bottom 17, and have it penetrate the bottom formation to substantially the entire length of the drive pipe 27.

The running tool 25 also includes a J-slot, or other means to allow the drill string to be released and pass therethrough. In one position, the length of drill string extending through the running tool 25 is fixed with the drive pipe 27 to travel downwardly together. In a second position, the drill string can move downwardly, to pass through the drive pipe 27, while the drive pipe 27 remains stationary.

Located directly below the running tool 25, and extending downwardly within the drive pipe 27, is an impact tool 29. The impact tool 29 functions to impart, through the running tool 25, a downward jarring force to the top of the drive pipe 27 to assist in causing the drive pipe 27 to penetrate the bottom formation 17. The lower end of the impact tool 29 is connected to an additional string of drill collars 31, which extend downwardly, within the drive pipe 27 to substantially the bottom thereof. This length is approximately that of the aforementioned drive pipe.

A cushion sub 33 is mounted directly below the lower section of drill collars 31 and is adapted to function as a means to cushion the impact energy passing through to the bottom hole assembly described below.

This bottom hole assembly comprises a downhole motor 35 connected to a stabilizer 37 and a drill bit 39. The motor is hydraulically driven to impart a rotary motion to an output shaft which, in turn, drives the stabilized drill bit 39. The drill bit 39 extends near the mouth of the drive pipe 27 and operates to drill into the bottom formation 17 as the drive pipe is being driven, and with its jetting action, drill a borehole approximately the size of the inside diameter of the drive pipe 27. During the initial operation of the drilling assembly, the drive pipe 27 penetrates the bottom formation by gravity, as the borehole is being drilled. However, after a while, the skin friction of the drive pipe and the formation outside the drive pipe increases to the point at which it can no longer be overcome by the forces of gravity and any further penetration of the drive pipe ceases. At this point, the impact tool 29 is used to impart a jarring force to the drive pipe 27 to assist in the penetration thereof. A more detailed description of the operation will be given with a further description of the components already described.

Figure 2A:
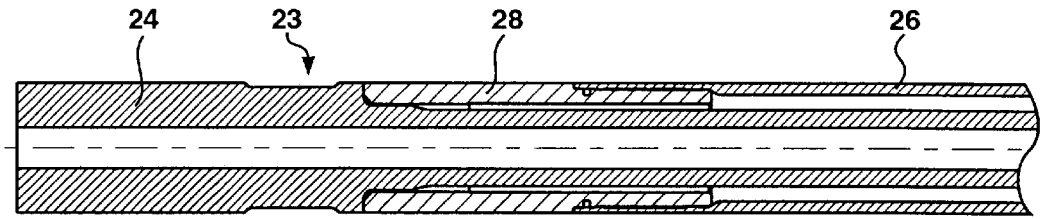
FIGS. 2A–2C are side cross-sectional views of an isolator sub of the present invention, shown in a collapsed position.
Figure 3A:
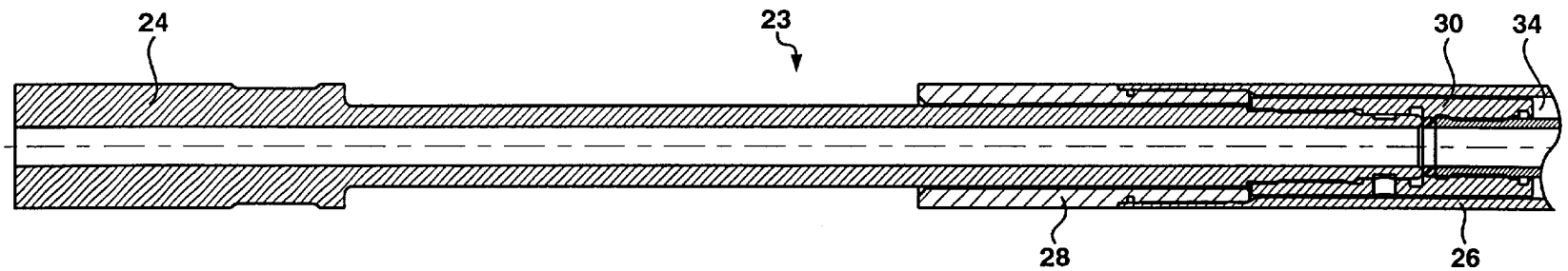
FIGS. 3A–3C are side cross-sectional views of the isolator sub shown in FIGS. 2A–2C, except in these figures, the isolator sub is shown in a fully elongated position.
Figure 2B:
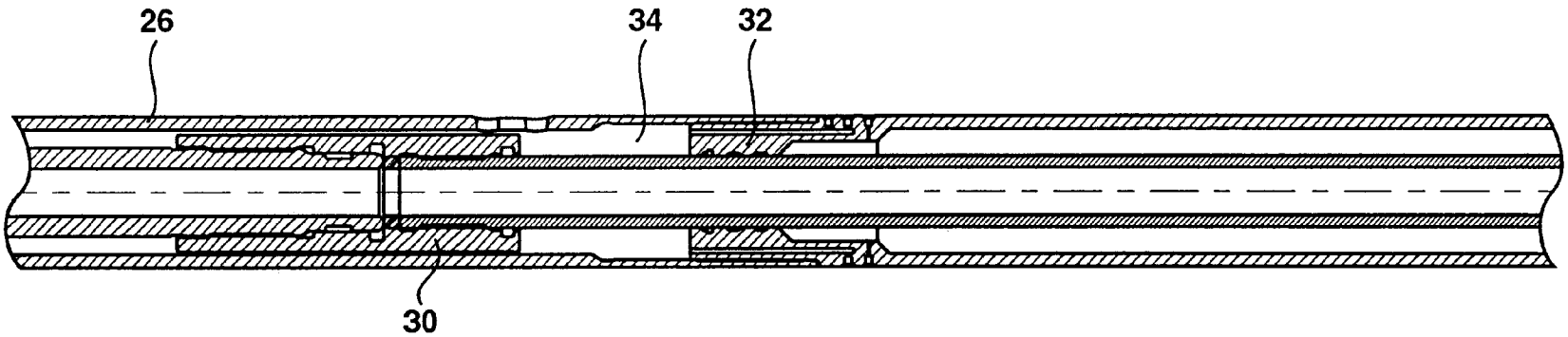
Figure 3B:
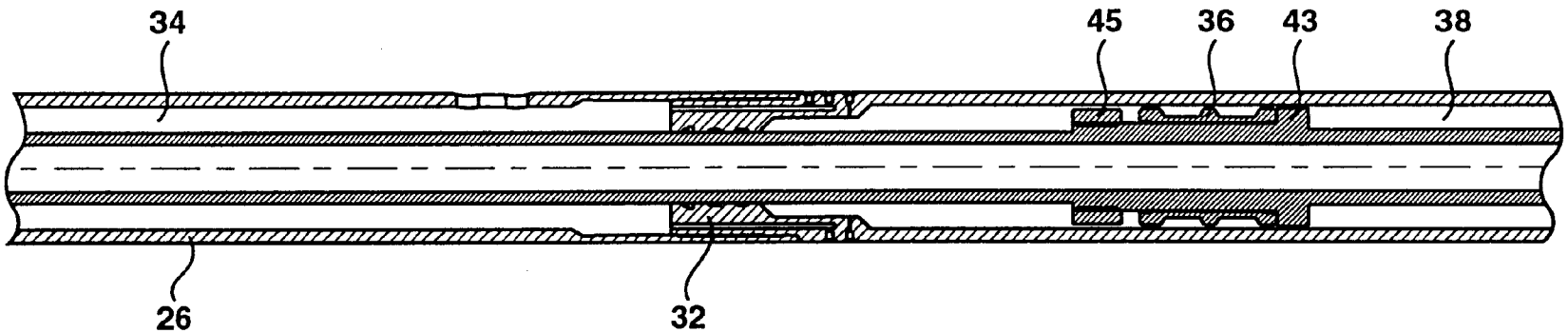
Figure 2C:
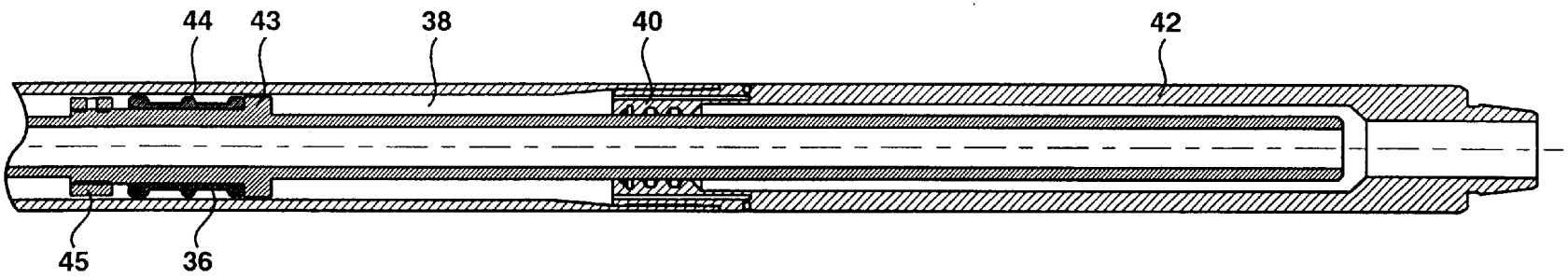
Figure 3C:
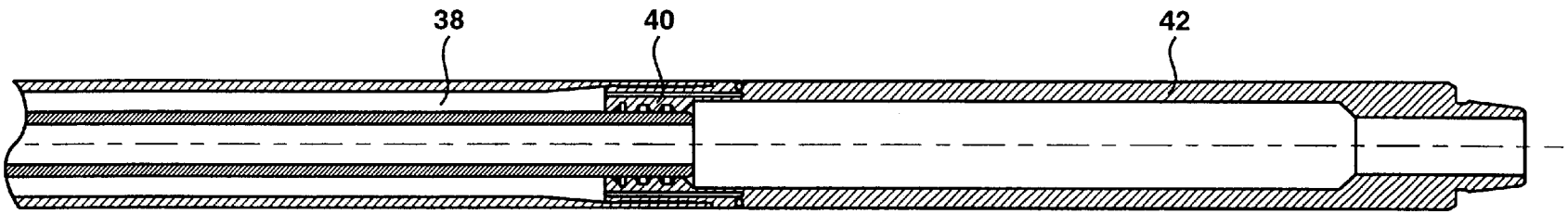
Figure 5A:
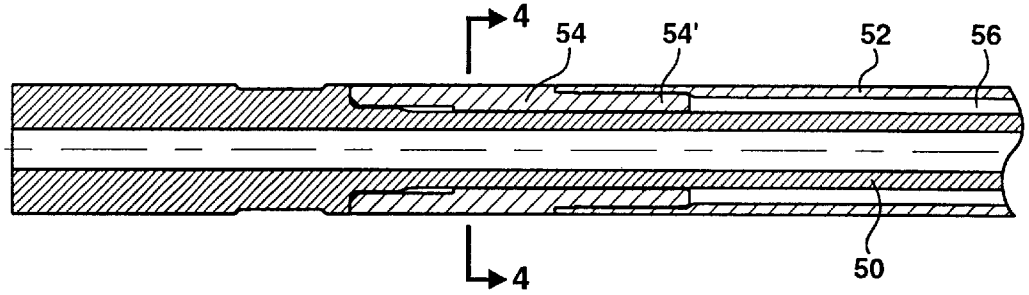
FIGS. 5A–5G are side cross-sectional views of the impact tool of FIG. 4, wherein the impact tool is shown in a fully closed position.

Referring now to FIGS. 2A–2C and 3A–3C, the isolator 23 will be described going from left to right on the figures, with the far left being the upper end of the tool, and the far right being the lower end of the tool as it is positioned in the drill string. FIGS. 2A–2C are side cross-sectional views of the isolator sub 23 shown in a collapsed position and in FIGS. 3A–3C the isolator sub 23 is shown in a fully elongated position. The upper end of the isolator 23 begins with a kelly mandrel 24 which is adapted to be connected to the lower end of the drill string extending down from the platform. The mandrel is a tubular element which is adapted to extend within a kelly cylinder 26. The upper end of the kelly cylinder 26 forms a drive cylinder 28, which is internally shaped as a six sided polygon to register with the kelly mandrel 24, which is externally shaped as a six sided polygon. Other drive means, such as pins may also be used. This structure enables the kelly mandrel to move longitudinally with respect to the drive cylinder and kelly cylinder, while being prevented from rotating with respect thereto. The lower end of the kelly cylinder 26 includes an end wall 32, which enables a chamber 34 to be formed between the drive cylinder 28 and the end wall 32. A hammer 30 is mounted on the kelly mandrel 24 and is adapted to reciprocate within the chamber 34. The chamber 34 is vented to the exterior of the tool to allow drilling fluid to enter the chamber.

The cylinder and mandrel continue downwardly below the end wall 32 to form an enclosed chamber 38. The lower end of the chamber terminates 38 at a lower end wall 40. The chamber 38 is pressurized with gas. A valve 36 is mounted on the mandrel to reciprocate within the chamber 38. The valve 36 comprises a ring 43 formed on the mandrel, and a cylindrical sleeve 44 slidably mounted on the mandrel. The sleeve 44 is retained on the mandrel by a ring 45.

The valve 36 prevents any transfer of fluid therethrough and functions to prevent any flow of fluid between the inner and outer members of the tool as the exterior member of the tool is moved downwardly in respect to the inner mandrel. This forces the fluid above the valve to be compressed to cushion and restrain the movement between the inner and outer members of the tool. In the extreme position of downward movement of the exterior of the tool, the hammer 30 will abut against the shoulder of the drive cylinder 28. As a result, the fluid in chamber 38 above the valve 36 is compressed during this movement to impede the movement of the mandrel. It should also be noted that other mediums such as gas or mechanical springs may be used in this tool.

Figure 4:
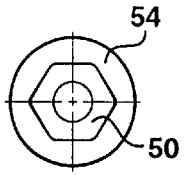
FIG. 4 is an end cross-sectional view of a section of an impact tool of the present invention. The view is a cross-section at line 4—4 shown in FIG. 5A, described below.
Figure 6A:
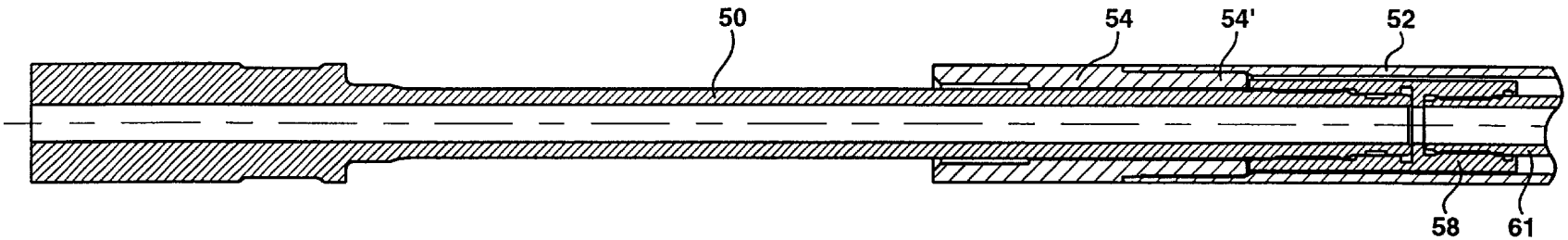
FIGS. 6A–6G are side cross-sectional views of the impact tool of FIGS. 4 and 5A–5G, wherein the impact tool is shown in a fully opened position.
Figure 5B:
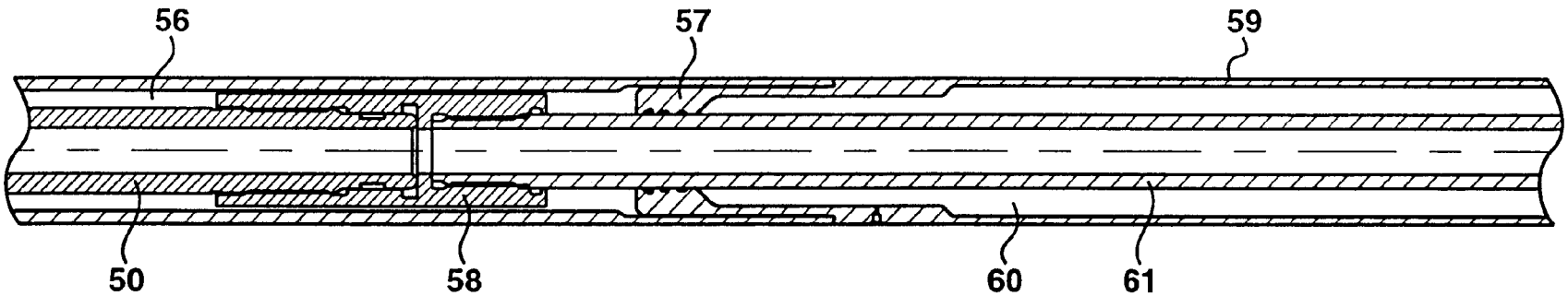
Figure 6B:
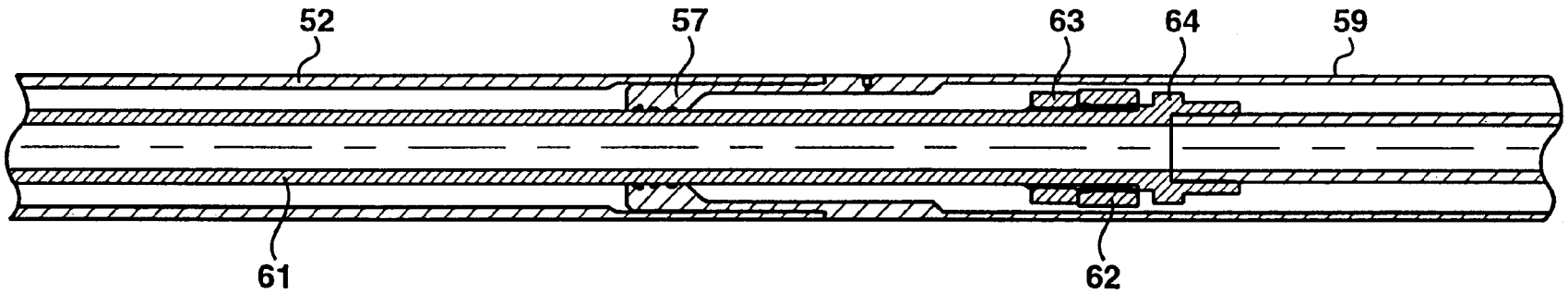
Figure 5C:
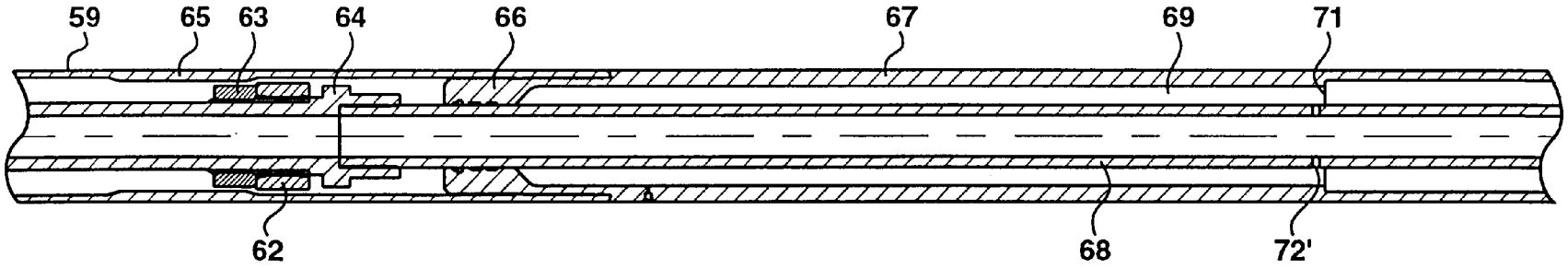
Figure 6C:
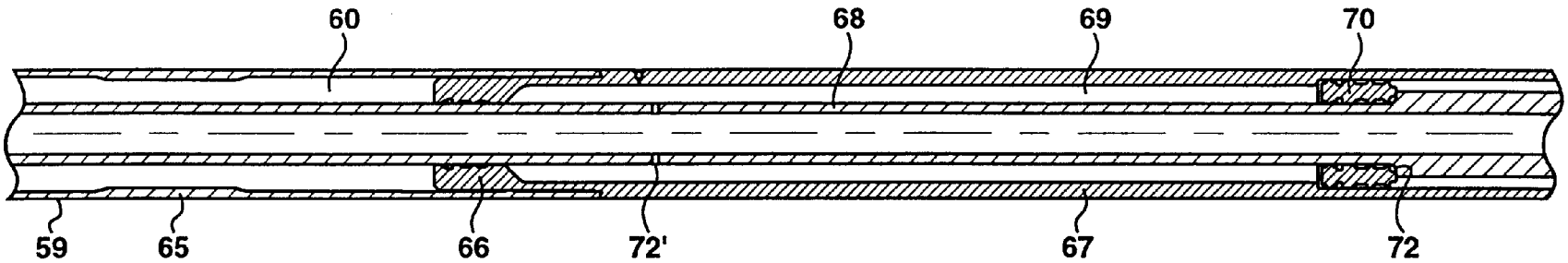
Figure 5D:
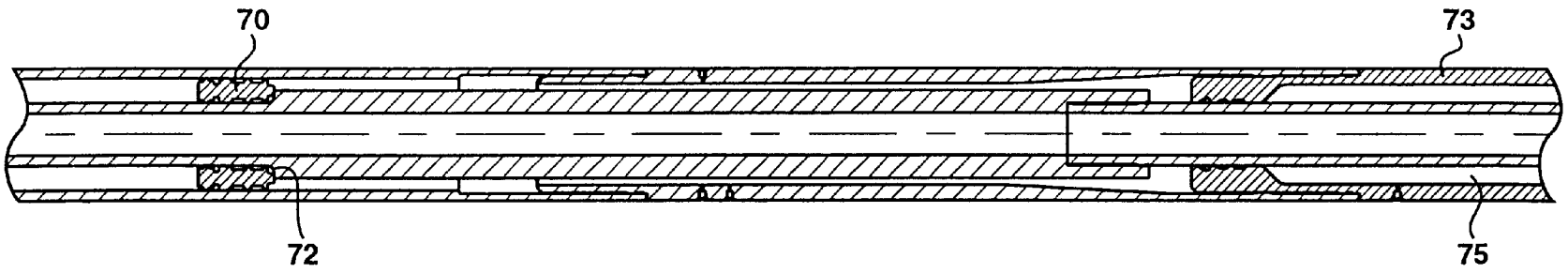
Figure 6D:
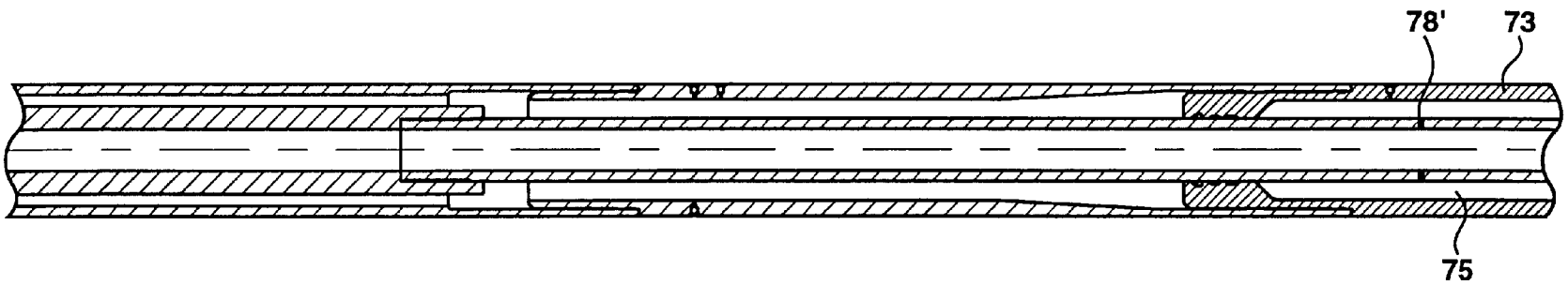
Figure 5E:
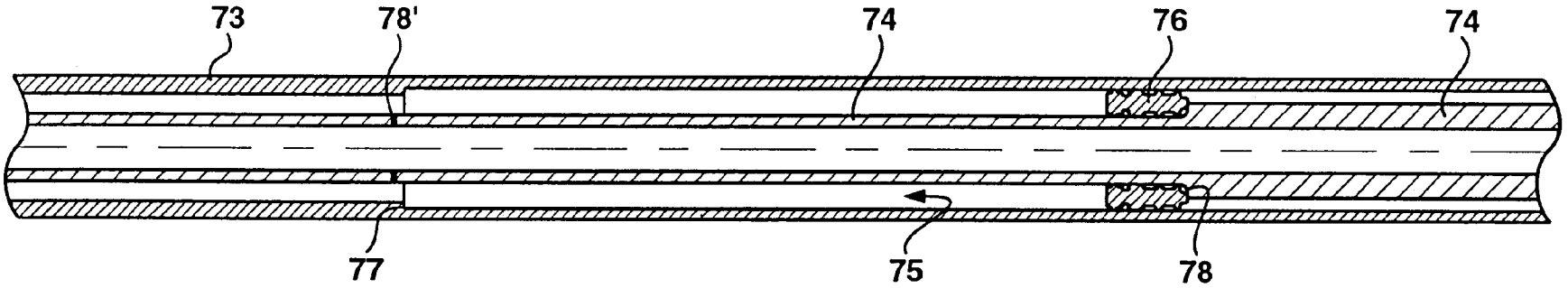
Figure 6E:
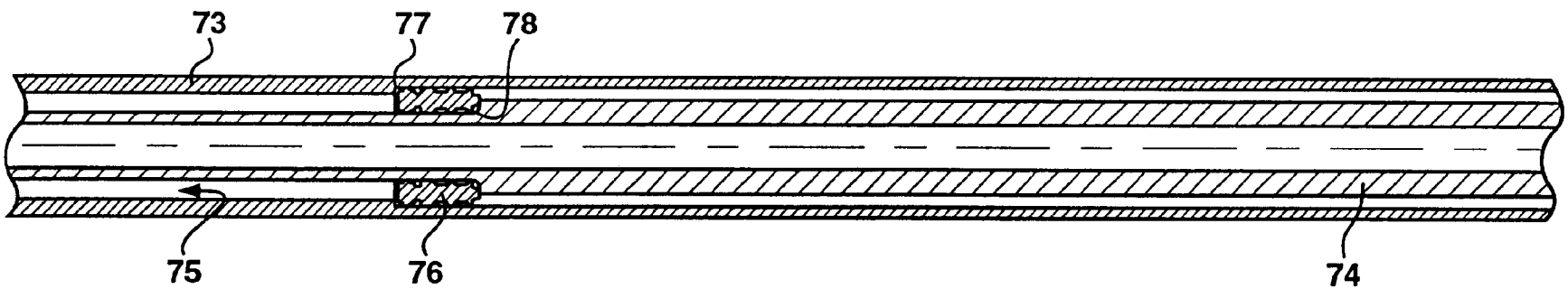
Figure 5F:
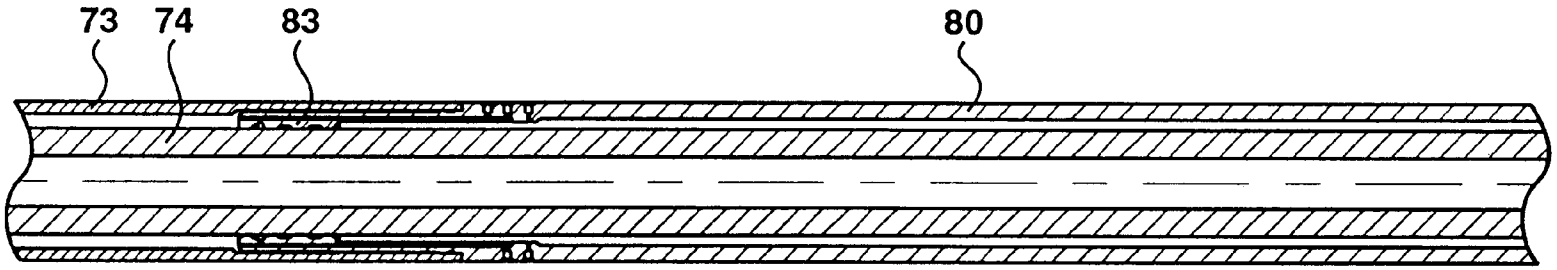
Figure 6F:
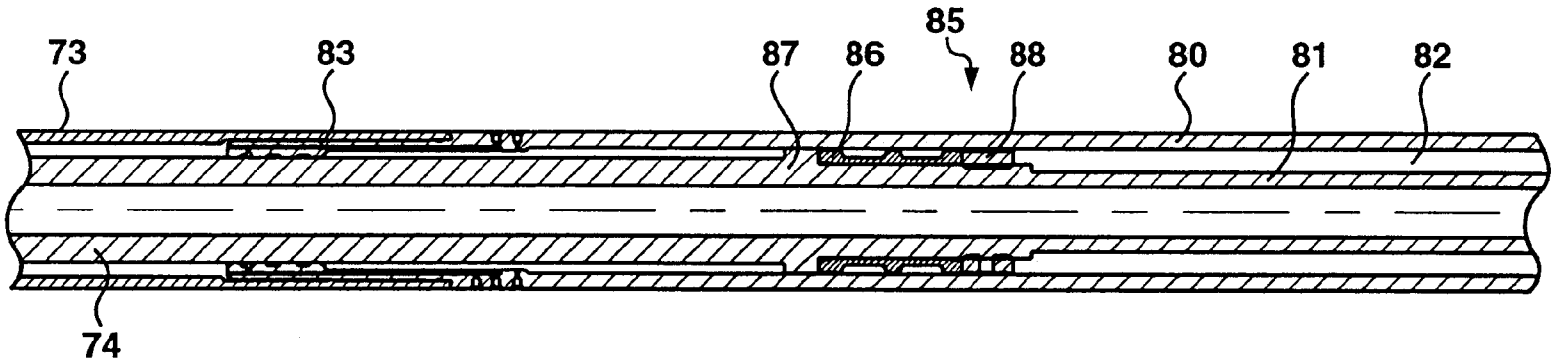
Figure 5G:
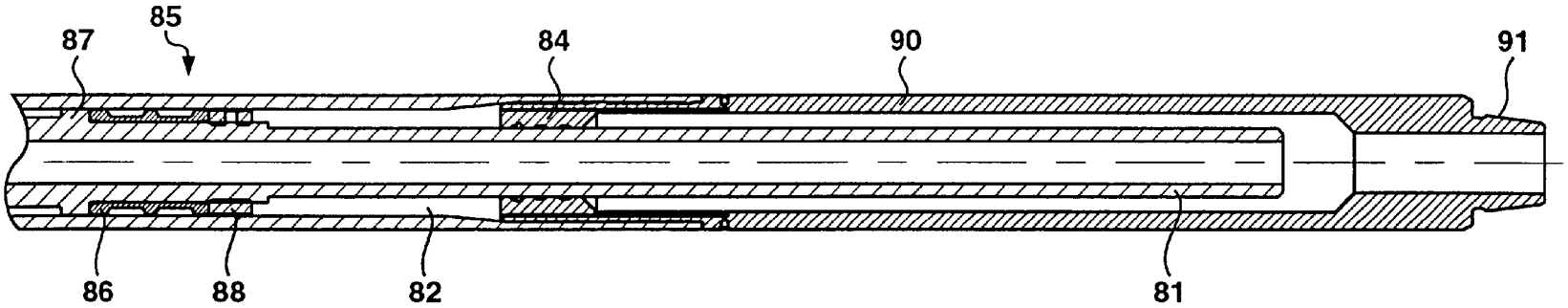
Figure 6G:
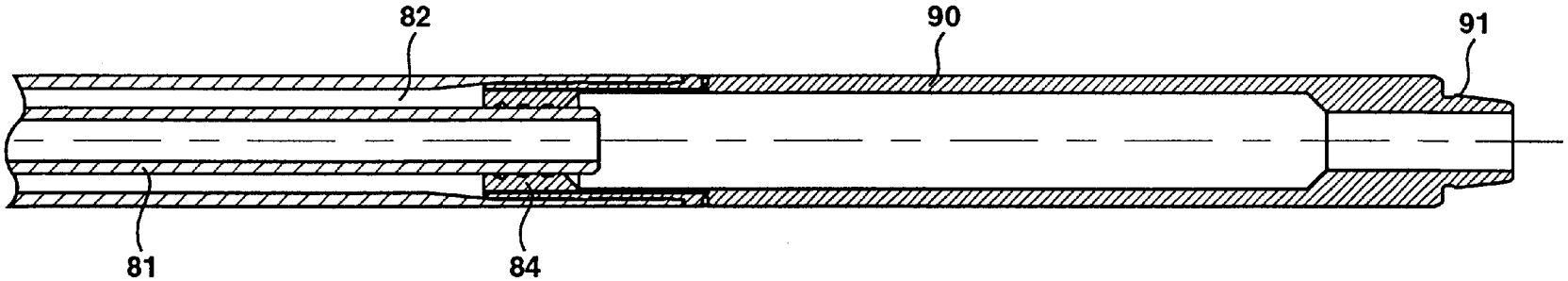

In summary, the isolator 23 functions to absorb the shock of the jarring downward movement of the drive pipe and isolate such impact loads from the drill string located above the isolator 23. The isolator 23 also allows the drill string to be freely lowered relative to the drive pipe 27. p FIGS. 4, 5A–5G and 6A–6G illustrate an embodiment of the impact tool 29. The upper end of the tool 29 comprises a kelly mandrel 50 which is adapted to be connected to the lower extending tubular member of the running tool 25. The kelly mandrel 50 is adapted to extend within a kelly cylinder 52. The upper end of the kelly cylinder 52 includes a drive cylinder 54. As shown in FIG. 4, the interior of the drive cylinder 54 is configured as a six-sided polygon, while the kelly mandrel 50 has a mating exterior shaped as a six-sided polygon. As with the isolator tool, this structure on the impact tool enables the kelly mandrel 50 to reciprocate within the kelly cylinder 52 without any relative rotation. The kelly mandrel 50 and cylinder 52 also coact to for m a chamber 56 therebetween. A hammer 58 is mounted on the end of the kelly mandrel 50 and a detent mandrel 61. An end wall 57 forms the lower end of the chamber 56. The lower end of the drive cylinder 54 includes a shoulder 54' which is adapted to strike the upper end of the hammer 58 when the exterior of the impact tool 29 is allowed to drop with respect to the interior of the tool.

The impact tool 29 further comprises a detent cylinder 59 cooperating with the detent mandrel 61 to form an annular chamber 60 therebetween. A detent ring 62 is adapted to be slidably mounted on the detent mandrel 61 and to abut against an annular projection 64. A retainer 63 is adapted to be secured to the detent mandrel 61 to retain the detent ring 62 in position. An end wall 66 forms a barrier between the detent annular chamber 60 and the upper end of lift chamber 69. The detent cylinder 59 also includes an inwardly extending cylindrical projection 65. In alternative embodiments of the invention, detents similar to those disclosed in U.S. Pat. No. 5,174,393, incorporated herein by reference, are used. The operation of this mechanism will be described later with the overall operation of the tool.

The impact tool 29 further includes an upper lift section comprising a lift cylinder 67 and an interior lift mandrel 68, with a lift chamber 69 formed therebetween. A lift piston 70 is mounted within the lift chamber 69 and is adapted to abut against a shoulder 71 on its upper end and against a shoulder 72 on its lower end. The chamber is adapted to be pressurized with hydraulic pump pressure through ports 72'. This fluid pressure functions to pressurize the chamber 69 to lift the external members of the tool with respect to the interior mandrels.

The impact tool 29 further includes a lower lift section comprising a lift cylinder 73, a lift mandrel 74 having a chamber 75 formed therebetween. The lower lift section functions identically to the upper lift section and comprises a lower piston 76 abutting against shoulders 77 and 78.

According to alternative embodiments of the invention, the impact tool comprises alternative devices to actuate or lift the mass for impacting the drive pipe. For example, the impact tool may lift or actuate by a worm gear mechanism, a rack and pinion gear mechanism, an electro-magnetic servo device, a lever device, a pulley and cable mechanism, a pneumatic system, or any other system known to persons of skill in the art.

The impact tool 29 further includes an auxiliary gas impulse section comprising an outer cylinder 80 and an inner mandrel 81 forming an enclosed pressure chamber 82 therebetween. The chamber 82 is bounded at its ends by end walls 83 and 84. The chamber 82 is filled with a gas. A fluid valve 85 is mounted within the chamber 82 and comprises a sleeve 86 slidably mounted on the mandrel 81 and adapted to abut against a ring 87 formed on the mandrel 81. A retainer 88 is provided to retain the sleeve 86 on the mandrel 81. Finally, a bottom section 90 is located at the lower end of the tool and includes a pin section 91 which is adapted to be connected to the drill string supporting the bottom hole assembly.

Figure 7A:
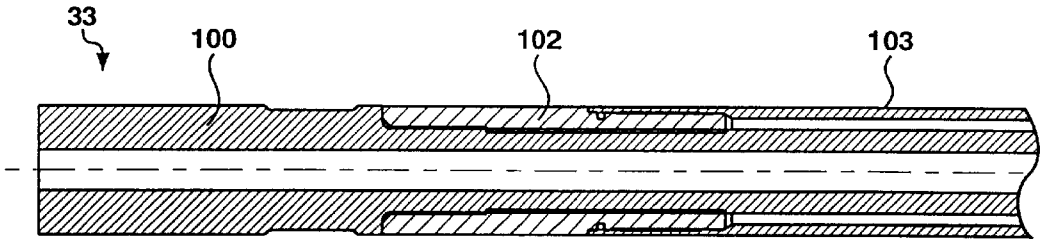
FIGS. 7A–7C are side cross-sectional views of a cushion sub of the present invention, shown in a fully closed position.
Figure 8A:
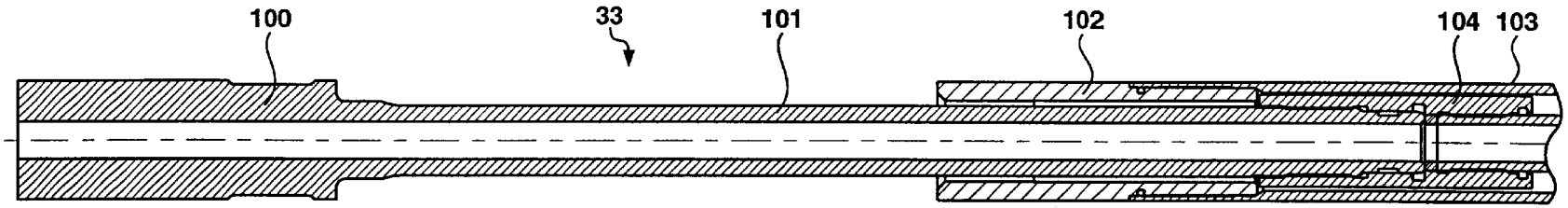
FIGS. 8A–8C are side cross-sectional views of the cushion sub of FIGS. 7A–7C, wherein the cushion sub is shown in a fully opened position.
Figure 7B:
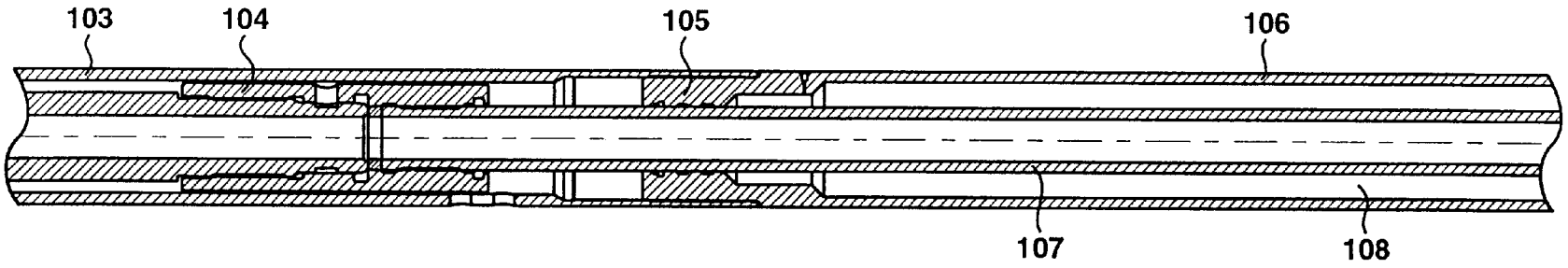
Figure 8B:
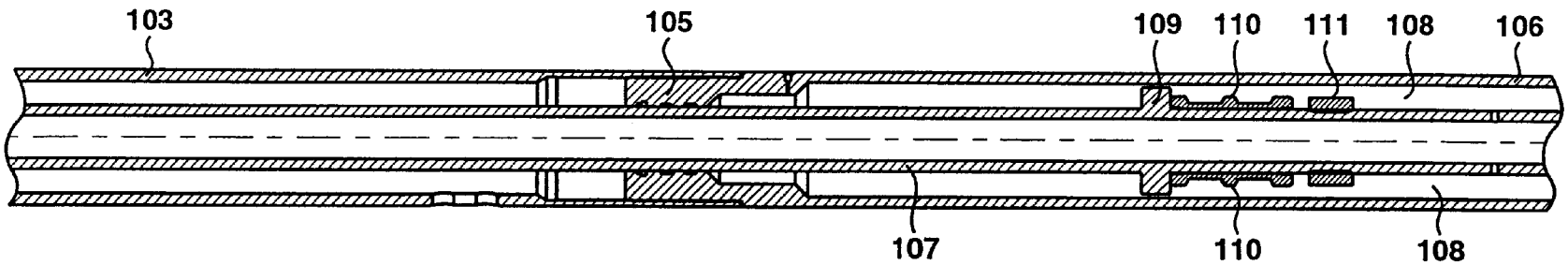
Figure 7C:
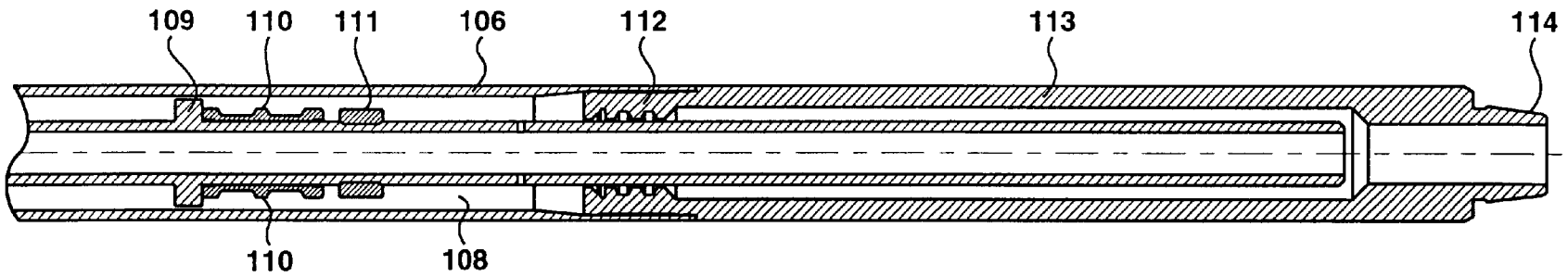
Figure 8C:
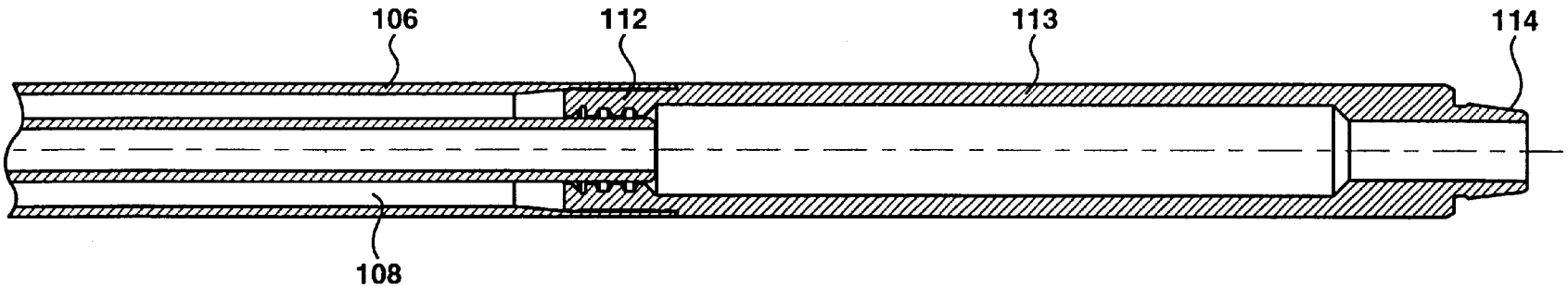
Figure 9A:
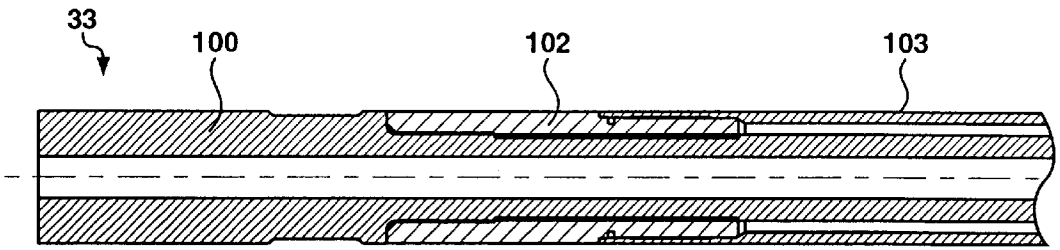
FIGS. 9A–9C are side cross-sectional views of a second embodiment of a cushion sub, shown in a closed position.

FIGS. 7A–7C and 8A–8C show, in detail, the cushion sub 33 which is mounted directly below the lower section of drill collars 31. FIGS. 7A–7C are side cross-sectional views of the cushion sub, shown in a fully closed position, and FIGS. 8A–8C are similar views of the cushion sub shown in a fully opened position. The top of the cushion sub 33 comprises a kelly mandrel 100, which is adapted to be connected to the lower end of the drill collars 31. The kelly mandrel 100 extends downwardly to form an inner tubular member 101, which extends within a drive cylinder 102 and a cylinder 103. The portion of the inner tubular member 101 extending through the drive cylinder 102 is configured like the inner drive members of the isolator 23 and impact tool 29 to register with the interior of the drive cylinder 102. The interior of the drive cylinder 102 is configured like the other drive cylinders to enable the inner member 101 to reciprocate with respect to the drive cylinder 102, while being prevented from relatively rotating with respect thereto.

A knocker 104 is mounted on the lower end of the inner tubular member 101. The lower end of the knocker 104 is connected to an inner tubular member 107 which, in turn, extends through an end wall 105. Beneath the end wall 105, the inner member 107 extends within a pressure cylinder 106. The intermediate portion of the inner tubular member 107 includes an enlarged flange 109 formed thereon. The flange 109 is similar to the previously mentioned flanges. A valve sleeve 110 is slidably mounted over the inner member 107 and is retained thereon by a retaining ring 111. This valve assembly is adapted to reciprocate within a pressure chamber 108 formed between the pressure cylinder 106 and the inner member 107. The pressure chamber 108 is pressurized with a fluid. The lower end of the pressure chamber 108 is formed by an end wall 112, through which the inner member 107 extends.

The lower end of the cushion sub 33 is formed by a bottom cylinder 113, which terminates with a pin section 114. The pin section 114 is adapted to be threadedly connected to the lower section of drill collars.

FIGS. 9A–9C and 10A–10C show a second embodiment of the cushion sub, in which the only change in structure from the first embodiment is that the pressure chamber 108 is vented to the pump pressure found within the inner tubular member. In the first embodiment, the pressure chamber is enclosed with the pressurized fluid. This venting structure is accomplished by a plurality of ports 115 extending through the inner member 107. These ports enable the pressure chamber 108 to communicate with the pump pressure inside the inner member 107. Furthermore, a piston 116 and flange 117 are substituted for the valve 110.

In operation, the impact tool 29 is shown in its fully retracted, or cocked (before-impact) position in FIGS. 5A–5G. In FIGS. 6A–6G, the impact tool is shown in an extended or after-impact position. To activate or cock the tool, the pump pressure from the floating platform 11 is increased. This increase in pressure travels down the interior of the drill string. Inside the tool, this increase in pump pressure passes through the ports 72' and 78' to increase the pressure within the lift chambers 69 and 75, which, in turn acts on the lift pistons 70 and 76 to cause the pistons to abut against shoulders 72 and 78. This causes the lift chambers 69 and 75 to expand to enable the outer lift cylinder 80, along with the hanging assembly below it, to rise with respect to the interior of the tool. To accomplish this, the force exerted to expand the chambers 69 and 75 must overcome the weight of the hanging assembly beneath the tool.

While this upward movement of the outer assembly continues, the gas within the chamber 82 located below the fluid valve 85 is compressed, because the action of the valve is to close as it moves relatively closer to the lower end wall 84, and the chamber becomes smaller. This movement continues until the drive cylinder 54 contacts the lower shoulder of the kelly mandrel 50. This is the fully cocked position shown in FIGS. 5A–5G.

When in the fully cocked position, the pump pressure is reduced until the lifting force is less than the weight of the assembly beneath the tool. When this occurs, two things happen. First, the weight of the assembly below the tool, and the auxiliary force from the chamber 82, causes the outer structure of the tool, and the hanging assembly, to move downwardly. Secondly, in the fully cocked position the detent ring assembly 62 is located below the restriction of the cylindrical projection 65. As the restriction of the cylindrical projection 65 passes downwardly relative to the ring 62, fluid flow is stopped from passing around the ring 62 and the fluid within the chamber above the ring is sufficient to support the hanging assembly. The ring 62 does permit a small amount of fluid to pass through the small ports inside the ring to allow the hanging assembly to move downwardly as the pressure chambers 69 and 75 are being evacuated. Finally, as the restriction 65 passed completely passes over the ring 62, the fluid in the chamber 60 is allowed to freely pass over the ring 62 to provide no further resistance to the downward movement of the hanging assembly. In addition, the gas charge below the lift pistons 70 and 76 raises the lift pistons off the lower shoulders 72 and 78 to rest against the upper shoulders 71 and 77. This enables the pistons to be removed from contact with shoulders 72 and 78 and not restrict the falling movement of the hanging assembly. The ring 62 functions as a delay mechanism to allow sufficient time for the various chambers to be evacuated, before the full force of the hanging weight and the auxiliary pressure act on the tool. As a result, this movement of the hanging assembly, accelerated by the fluid pressure, causes the outer structure to impact onto the hammer 58 and the inner structure of the tool to transfer this impact energy to the top of the drive pipe as shown in FIGS. 6A–6G.

During this operation, the isolator 23 functions in the following manner. The initial position of the isolator is shown in FIGS. 2A–2C. This position is dependent on the weight of the hanging assembly below the tool, and must be balanced with the gas pressure in the isolator 23. In other words, the initial gas pressure in the isolator is predetermined by the known weight to be suspended. In addition, the stroke of the isolator, i.e., the amount of elongation of the tool between FIGS. 2A–2C and 3A–3C, should accommodate the amount of movement of the impacted drive pipe 27. If not, any residual forces will be transferred upwardly to the platform. In operation, nothing happens to the isolator 23 until impact, and the hanging position is shown in FIGS. 2A–2C. Upon impact, the outer tubular structure moves downwardly equal to the amount the drive pipe 27 is moved upon impact. When this occurs, the chamber above the valve 36 becomes smaller. In this direction of movement, the valve 36 is closed to compress the fluid within the chamber. This action absorbs the energy caused by the impact and prevents any impact energy from being transferred above the isolator 23. The operator then lowers the drill string to restore the stroke, going from the position shown in FIGS. 3A–3C back to the position shown in FIGS. 2A–2C.

Figure 10A:
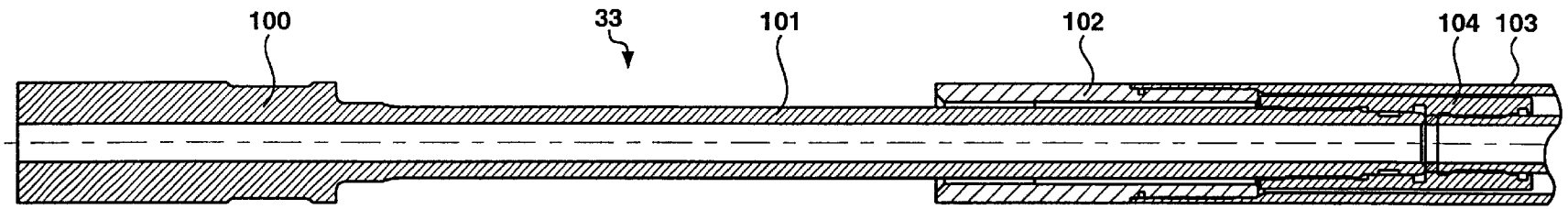
FIGS. 10A–10C are side cross-sectional views of the cushion sub of FIGS. 9A–9C, wherein the cushion sub is shown in an opened position.
Figure 9B:
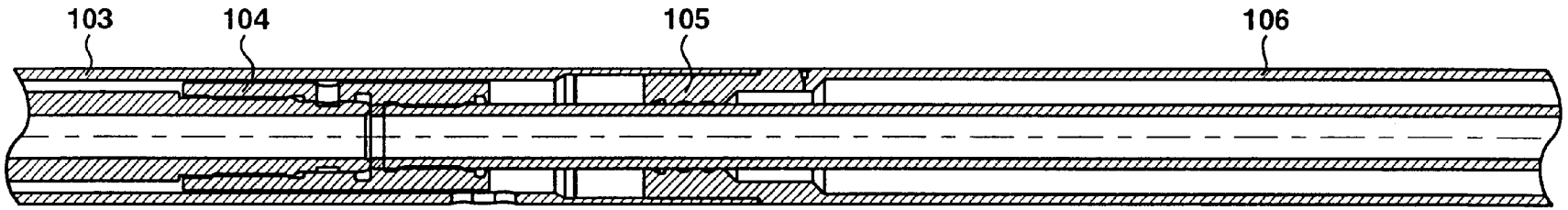
Figure 10B:
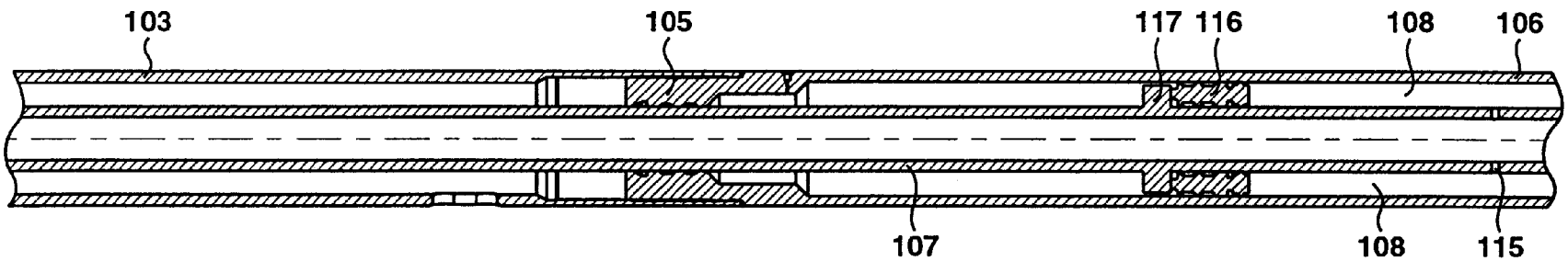
Figure 9C:
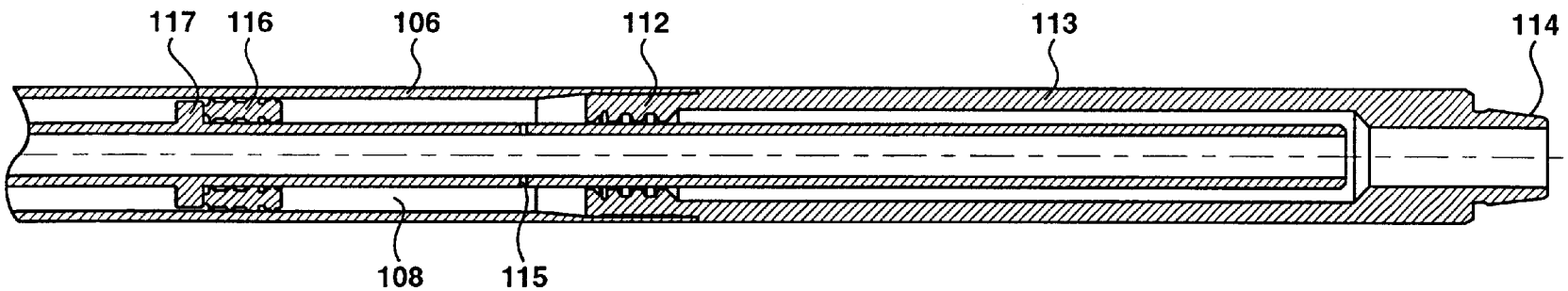
Figure 10C:
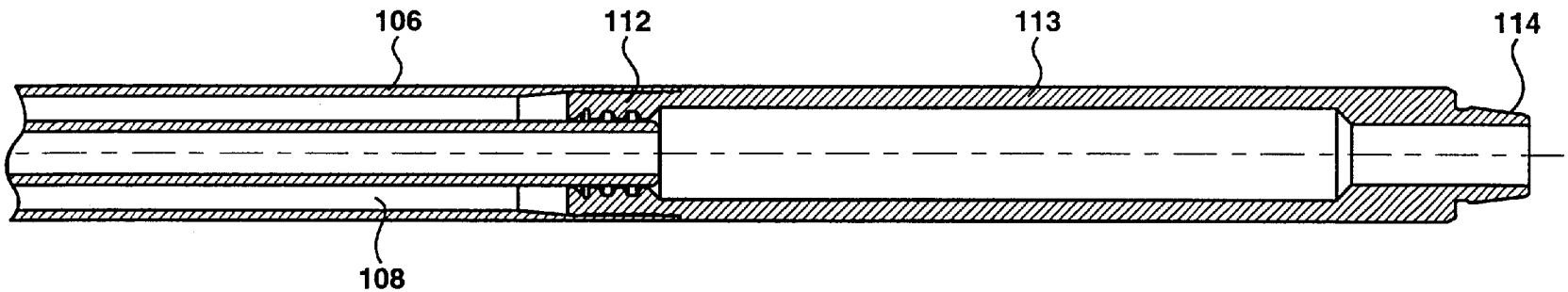

The cushion sub 33 operates from its initial position shown in FIGS. 10A–10C. In this position, the downward movement of the hanging assembly lowers the inner structure of the cushion sub 33. This movement causes the valve to compress the fluid in the chamber beneath the valve to absorb the energy of the impact of the bit 39 as it impacts the formation 17. The drilling of the bit 39 through the formation 17 causes the sub 33 to move from the position shown in FIGS. 9A–9C to that shown in FIGS. 10A–10C.

Figure 11A:
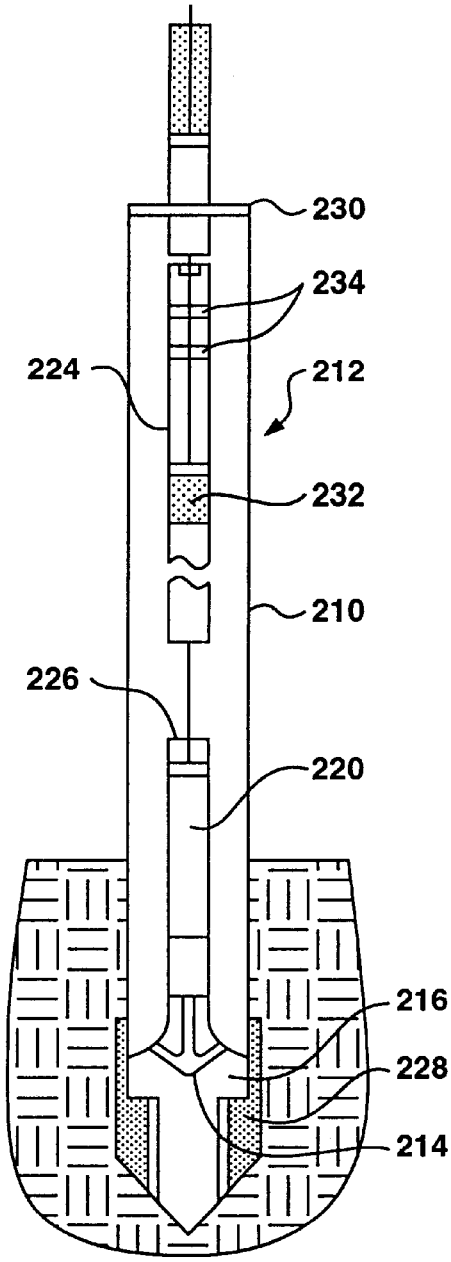
FIG. 11A is a cross-sectional side view of a system for driving a drive pipe into the sea bottom formation according to the present invention. The system has an impact surface with the drive pipe near the driving shoe of the drive pipe. The system is shown in a before-impact configuration.
Figure 11B:
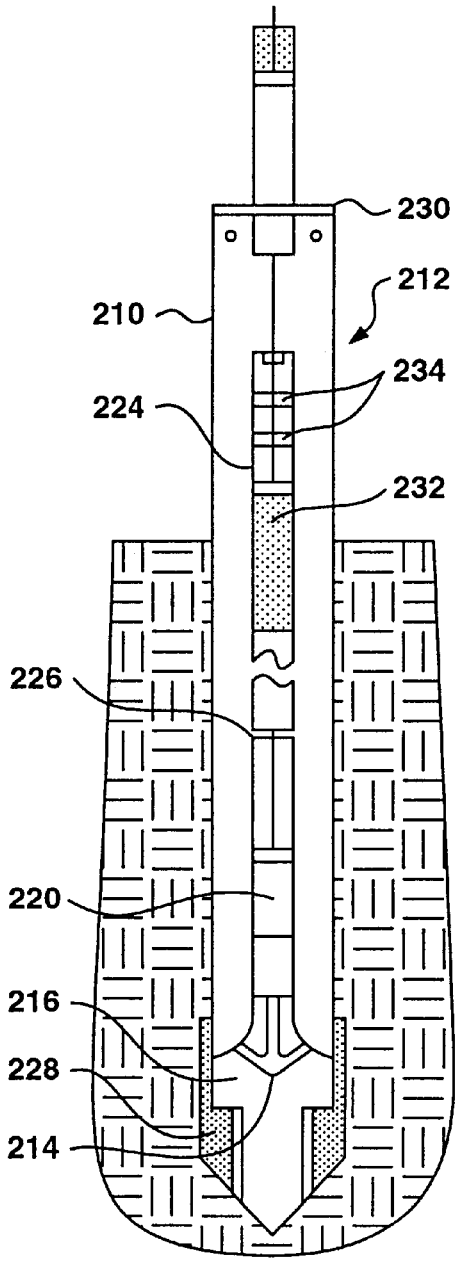
FIG. 11B is a cross-sectional side view of the system shown in FIG. 11A, except that in this figure, the system is shown in an after-impact configuration.

With reference to FIGS. 11A and 11B, an alternative embodiment of an assembly 212 of the present invention is shown wherein drive pipe 210 is impacted from its inside toward its bottom. The system shown in FIG. 11A is in a before-impact configuration, while the system depicted in FIG. 11B is in an after-impact configuration. With this embodiment, the impact loads, the location of the impact within the length of the drive pipe, and the equal distribution of a large uniform mass may be altered to fit the parameters of the particular application. Each of these factors contributes to the desirability and performance of the tool.

Figure 11C:
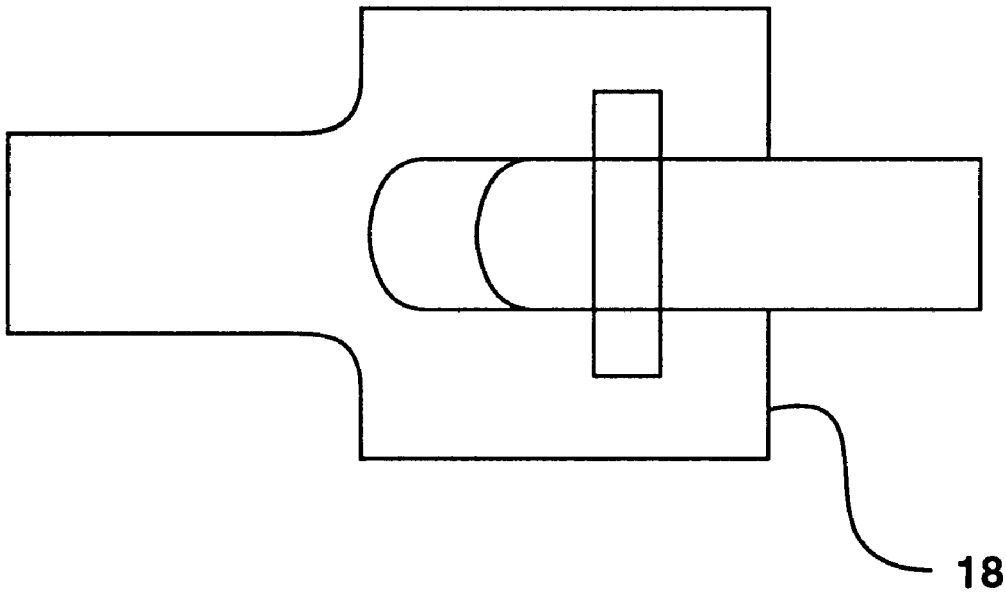
FIG. 11C is a cross-sectional view of a release mechanism of the driving shoe of the system shown in FIGS. 11A and 11B.

As shown in FIGS. 11A and 11B, the impact tool 224 imparts a jarring force to the bottom or leading end of the drive pipe 210, wherein a driving spear 214 sits on a driving shoe 216. The driving shoe 216 and driving spear 214 are rotationally and axially locked together with a shear device 218 (see FIG. 11C). Under impact loads, the driving shoe 216 and driving spear 214 perform as a single, integral unit. Above the driving spear 214 is conventional bumper sub 220 or slack joint, having a stroke length somewhat greater than the available downward travel of the impact tool 224. Consequently all impact forces from the impact tool 224 are imparted to the impact surface 226 of the bumper sub 220 rather than the top of the drive pipe 210 through the running tool 230. This impact force is transferred through the bumper sub 220 to the driving spear 214 to the driving shoe 216 to internal shoulder 228 of drive pipe 210. Although this method may also use a driving cone similar to that which is proposed for use with a hydraulic hammer, impact forces achieved by the present invention are sufficiently large to overcome the negative effect thereof. Similar to the previously described impact tools, the impact tool 224 has a gas accelerator 232 and two hydraulic lift pistons 234. The impact tool 224 in this embodiment is disposed within drive pipe 210 below the running tool 230 which is removably connected to the top of the drive pipe 210.

Figure 12A:
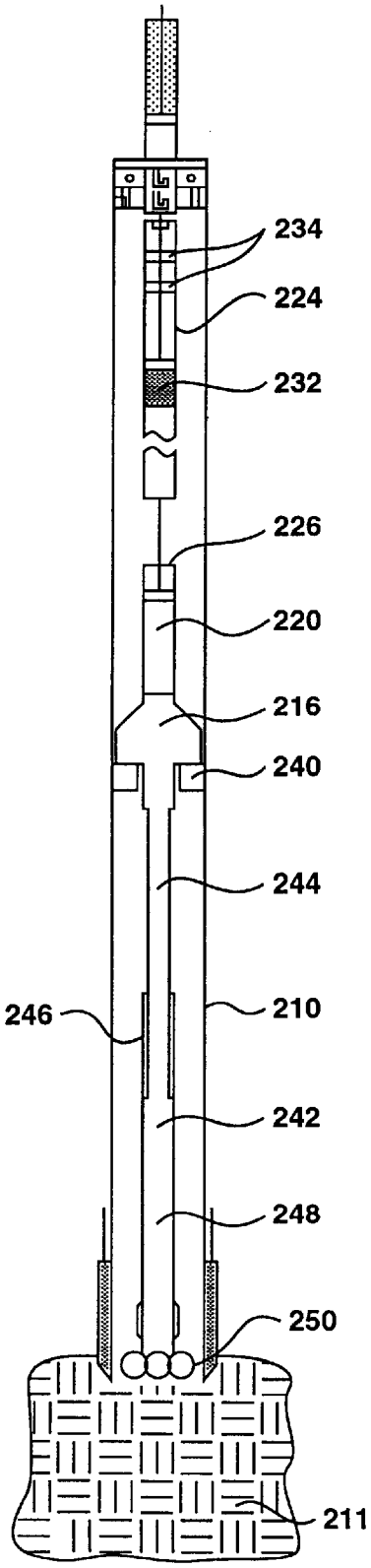
FIG. 12A is a cross-sectional side view of a system for driving a drive pipe into the sea bottom formation according to the present invention. The system has an impact surface with the drive pipe at a midpoint location on the drive pipe, and a drilling motor suspended below the impact tool. The system is shown in a before-impact configuration.
Figure 12B:
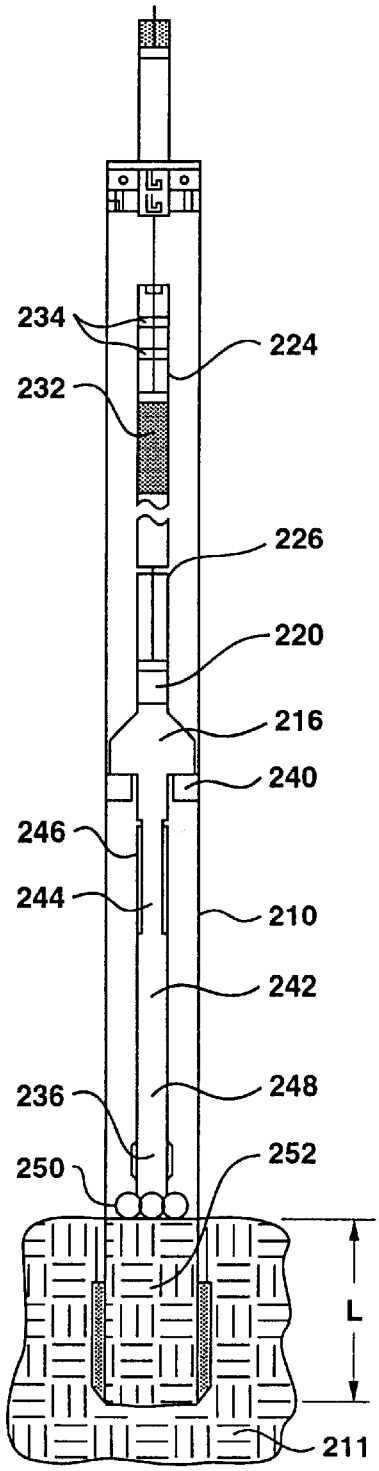
FIG. 12B is a cross-sectional side view of the system shown in FIG. 12A, except that in this figure, the system is shown in an after-impact configuration.

As shown in FIGS. 12A and 12B, a downhole motor 236 is used to drill out the formation "core". The system shown in FIG. 12A is in a before-impact configuration, while the system depicted in FIG. 12B is in an after-impact configuration. The embodiment of FIGS. 12A and 12B is similar to that of FIGS. 11A and 11B in driving function and components. The difference in the embodiment shown in FIGS. 12A and 12B is that the impact point with drive pipe 210 is moved upward to an interior shoulder 240 of the drive pipe 210. The driving shoe 216 is modified to be disposed on the shoulder 240 for impact therewith upon impact by the impact tool 224 on the surface 226 of the bumper sub 220. Beneath the driving shoe 216 is a telescoping sub 242 with a top portion 244 connected to the driving shoe 216 and a bottom portion 246 slidably connected to the top portion 244. A drilling motor 248 is connected to the bottom portion 246 and has a drilling bit 250 mounted at the bottom thereof.

In operation, upon impact, drive pipe 210 is driven down into a formation 211 by length L. The bottom portion 246 of the telescoping sub 242, with the drilling motor 248 and the bit 250 attached to its distal end, initially stay fixed relative to the formation 211. The top portion 244 of the telescoping sub along with the driving shoe 222 and drive pipe 210 move downward into the formation 211 by a length L. Once the impact is over, the drill bit 250 is rotated by the drilling motor 248 to remove the core 252 of the formation 211 within the drive pipe 210 until the bit 250 is once again proximate the bottom of drive pipe 210 as shown in FIG. 12A.

In these embodiments, the area of impact to the drive pipe can be placed virtually anywhere within the length of the drive pipe, and if desired, may also be placed in close proximity to the bottom. By virtue of the "floating" downhole motor, it is also possible to remove the "core" as the drive pipe is being driven, which will remove all skin friction from inside the drive pipe as it is being driven, thus allowing the drive pipe to be driven deeper.

While the particular embodiments for assemblies and methods for jarring a drilling drive pipe into undersea formations as herein shown and disclosed in detail are fully capable of obtaining the objects and advantages hereinbefore stated, it is to be understood that they are merely illustrative of the preferred embodiments of the invention and that no limitations are intended by the details of construction or design herein shown other than as described in the appended claims.

What is claimed is:

1. A method for driving a drive pipe into a subsea formation, said method comprising:

accelerating at least one mass relative to the drive pipe, wherein the at least one mass is accelerated within the drive pipe;

transferring energy from the accelerated at least one mass to the drive pipe;

suspending the drive pipe from a drill string; and isolating the drill string from the transferred energy from the accelerated at least one mass.

2. A method as claimed in claim 1, wherein said suspending comprises removably attaching the drive pipe to the drill string, and wherein said isolating the drill string comprises placing an elastic device between the drill string and the drive pipe.

3. A method for driving a drive pipe into a subsea formation, said method comprising:

suspending the drive pipe from a drill string;

moving at least one mass in a direction having an upward component and within the drive pipe;

accelerating at least one mass relative to the drive pipe, wherein the at least one mass is accelerated within the drive pipe;

transferring energy from the accelerated at least one mass to the drive pipe;

isolating the drill string from energy from the accelerated at least one mass; and removing a core of formation from within the drive pipe after said transferring.

4. A method as claimed in claim 3, wherein said transferring energy from the accelerated at least one mass to the drive pipe comprises transferring the energy near a top of the drive pipe.

5. A method as claimed in claim 3, wherein said transferring energy from the accelerated at least one mass to the drive pipe comprises transferring the energy to an intermediate portion of the drive pipe.

6. A method as claimed in claim 3, wherein said removing a core of formation comprises:

drilling with a drill bit within the drive pipe; and isolating the drill bit from energy from the accelerated at least one mass.

7. An impact tool for driving a drive pipe into a subsea formation, said impact tool comprising:

at least one mass adapted to fit within the drive pipe;

an accelerator of said at least one mass;

a first body member mechanically communicable with said at least one mass;

a second body member mechanically communicable with a drill string;

an actuator of said first and second body members relative to each other;

a detent of said first and second body members relative to each other; and a transferror of energy from said at least one mass to the drive pipe, wherein said transferror transfers energy after said at least one mass is accelerated by said accelerator, wherein said first body member is a sleeve and said second body member is a mandrel, wherein said actuator comprises at least one lift section between the sleeve and the mandrel, wherein said at least one lift section comprises a lift chamber defined by the mandrel and the sleeve, wherein overpressure within said lift chamber moves the mandrel and the sleeve relative to each other.

8. An impact tool as claimed in claim 7, wherein said lift chamber of said lift section is fluidly communicable with an interior of the drill string.

9. An impact tool as claimed in claim 7, wherein said lift section further comprises a lift piston within said lift chamber, wherein said lift piston engages the mandrel when the lift chamber is overpressurized, wherein said lift section further comprises a piston release chamber filled with a compressible fluid which disengages the lift piston from the mandrel when the lift chamber is underpressurized.

10. An impact tool as claimed in claim 7, wherein said accelerator comprises an impulse section that accelerates the at least one mass.

11. An impact tool as claimed in claim 10, wherein said impulse section comprises a pressure chamber filled with a compressible gas and defined by said first and second body members, wherein the volume of said pressure chamber is reduced upon relative movement of said first and second body members by said activator.

12. An impact tool for driving a drive pipe into a subsea formation, said impact tool comprising:

at least one mass adapted to fit within the drive pipe;

an accelerator of said at least one mass;

a first body member mechanically communicable with said at least one mass;

a second body member mechanically communicable with a drill string;

an actuator of said first and second body members relative to each other;

a detent of said first and second body members relative to each other, wherein said detent comprises:

a detent chamber filled with a fluid, wherein said detent chamber is in mechanical communication with said first body member;

a protrusion into said detent chamber, wherein said detent chamber has a first inside dimension in the proximity of the protrusion, wherein said detent chamber has a chamber section on opposite sides of said protrusion, each chamber section having a second inside dimension larger than the first inside dimension;

a piston within said chamber and in mechanical communication with the second body member, wherein said piston has an outside dimension smaller than the first inside dimension of said detent chamber, whereby fluid flowing between chamber sections is constrained by the piston and the protrusion when the piston is adjacent the protrusion; and a transferror of energy from said at least one mass to the drive pipe, wherein said transferror transfers energy after said at least one mass is accelerated by said accelerator.

13. A system for driving a drive pipe into a subsea formation, said system comprising:

a drill string suspendable from a marine vessel;

a running tool attachable to said drill string, wherein a top of the drive pipe is connected to said running tool;

at least one mass adapted to fit within said drive pipe;

an accelerator of said at least one mass, wherein said accelerator is in mechanical communication with said running tool and said at least one mass; and a transferror of energy from said at least one mass to the drive pipe, wherein said transferror transfers energy after said at least one mass is accelerated by said accelerator.

14. A system as claimed in claim 13, wherein said accelerator comprises a first body member mechanically communicable with said at least one mass;

a second body member mechanically communicable with the drill string;

an actuator of said first and second body members relative to each other, wherein said actuator works against gravity; and a detent of said first and second body members relative to each other.

15. A system as claimed in claim 13, wherein said drill string comprises an isolator sub between said drill string and said running tool.

16. A system as claimed in claim 15, wherein said isolator sub comprises:

a mandrel connected to a portion of said drill string;

a sleeve which is about said mandrel and connected to a second portion of said drill string;

a chamber between said sleeve and said mandrel which dampens relative movement between said mandrel and said sleeve; and a hammer between said mandrel and said sleeve which limits relative movement between said mandrel and said sleeve.

17. A system as claimed in claim 13, wherein said running tool comprises a lock mechanism which is configurable in attached and released configurations, wherein the running tool is immovably attached to the drill string in the attached configuration, and wherein the drill string freely moves relative to the running tool in the released configuration.

18. A system as claimed in claim 13, wherein said accelerator comprises:

a first body member mechanically communicable with the at least one mass;

a second body member mechanically communicable with the drive pipe;

an actuator of said first and second body members relative to each other, wherein said actuator works against gravity; and a detent of said first and second body members relative to each other.

19. A system as claimed in claim 18, wherein said first body member is a sleeve and said second body member is a mandrel, wherein said actuator comprises at least one lift chamber defined by said mandrel and said sleeve, wherein overpressure within said lift chamber moves said mandrel and said sleeve relative to each other, wherein said lift chamber is fluidly communicable with an interior of the drill string.

20. A system as claimed in claim 18, wherein said detent comprises:

a chamber filled with a fluid, wherein said chamber is in mechanical communication with said first body member;

a protrusion into said chamber, wherein said chamber has a first inside dimension in the proximity of the protrusion, wherein said chamber has a chamber section on opposite sides of said protrusion each chamber section having a second inside dimension larger than the first dimension;

a piston within said chamber, wherein said piston is in mechanical communication with said second body member, wherein said piston has an outside dimension smaller than the first inside dimension of said chamber, whereby fluid flowing between chamber sections is constrained by the piston and protrusion when the piston is adjacent the protrusion.

21. A system as claimed in claim 13, wherein said accelerator comprises an impulse section that accelerates said at least one mass.

22. A system as claimed in claim 13, wherein said transferror of energy comprises an impact shoe configured in the drive pipe near a top of the drive pipe.

23. A system as claimed in claim 13, wherein said transferror of energy comprises an impact shoe configured in the drive pipe near a bottom of the drive pipe.

24. A system as claimed in claim 13, wherein said transferror of energy comprises an impact shoe configured in the drive pipe near an intermediate portion of the drive pipe.

25. A system as claimed in claim 13, further comprising a drilling motor and drill bit suspended below said impact tool, wherein a stator of said drilling motor is in mechanical communication with said drill string, and wherein the drill bit is in mechanical communication with a rotor of said drilling motor.

26. A system as claimed in claim 25, further comprising a cushion sub between said at least one mass and said drilling motor.

* * * * *